US007997716B2

(12) United States Patent
Yokota

(10) Patent No.: US 7,997,716 B2
(45) Date of Patent: Aug. 16, 2011

(54) UV CURABLE INK-JET RECORDING APPARATUS

(75) Inventor: Yasuyo Yokota, Kanagawa (JP)

(73) Assignee: FujiFilm Corporation, Tokyo (JP)

( * ) Notice: Subject to any disclaimer, the term of this patent is extended or adjusted under 35 U.S.C. 154(b) by 620 days.

(21) Appl. No.: 12/057,106

(22) Filed: Mar. 27, 2008

(65) Prior Publication Data

US 2008/0239044 A1 Oct. 2, 2008

(30) Foreign Application Priority Data

Mar. 28, 2007 (JP) ..... P2007-085391

(51) Int. Cl.
*B41J 2/01* (2006.01)

(52) U.S. Cl. ..... 347/102

(58) Field of Classification Search ..... 347/102
See application file for complete search history.

(56) References Cited

U.S. PATENT DOCUMENTS 5,722,761 A * 3/1998 Knight ..... 362/96
2004/0179079 A1* 9/2004 Yokoyama ..... 347/102
2005/0012778 A1* 1/2005 Nishino et al. ..... 347/29
2005/0068397 A1* 3/2005 Yokoyama ..... 347/102
2006/0023045 A1* 2/2006 Yokoyama et al. ..... 347/102
2008/0239044 A1* 10/2008 Yokota ..... 347/102
2010/0149295 A1* 6/2010 Kulpa et al. ..... 347/102

FOREIGN PATENT DOCUMENTS

EP 1 498 274 A1 1/2005
EP 1 520 718 A1 4/2005
JP 2004-167917 A 6/2004
JP 2004-314586 A 11/2004
JP 2005-53221 A 3/2005

* cited by examiner

*Primary Examiner* — Matthew Luu
*Assistant Examiner* — Rut Patel
(74) *Attorney, Agent, or Firm* — Birch, Stewart, Kolasch & Birch, LLP

(57) ABSTRACT

A UV curable ink-jet recording apparatus includes: a recording medium transporting unit; an ink-jet head; and a UV irradiating unit, wherein the apparatus includes a light capturing portion between the UV irradiating unit and the ink-jet head, at least a part of the light capturing portion as seen in a longitudinal section taken vertically along a direction of transporting the recording medium has an opened wedge shape having no base side and comprising: a side vertical to the recording medium; and an oblique side which is in contact with a top of the vertical side, and which extends obliquely downward, the vertical side is located on the side of the ink-jet head, and the oblique side downward extends from the top toward the UV irradiating unit.

2 Claims, 3 Drawing Sheets

$\theta/16 \leqq \alpha \leqq \theta/n$ , $\tan\theta = 2b/a$ , $\beta = 180°$

THE VALUE OF n (1 ≦ N ≦ 15) DEPENDS ON THE SENSITIVITY OF THE INK, THE INTENSITY OF THE LIGHT SOURCE, AND THE UV REFLECTIVITY OF THE INNER FACE OF THE LIGHT CAPTURING PORTION $\theta/16 \leqq \alpha \leqq \theta/n$ , $\tan\theta = 2b/a$ , $\beta = 180°$ THE VALUE OF n ($1 \leqq N \leqq 15$) DEPENDS ON THE SENSITIVITY OF THE INK, THE INTENSITY OF THE LIGHT SOURCE, AND THE UV REFLECTIVITY OF THE INNER FACE OF THE LIGHT CAPTURING PORTION

FIG. 3

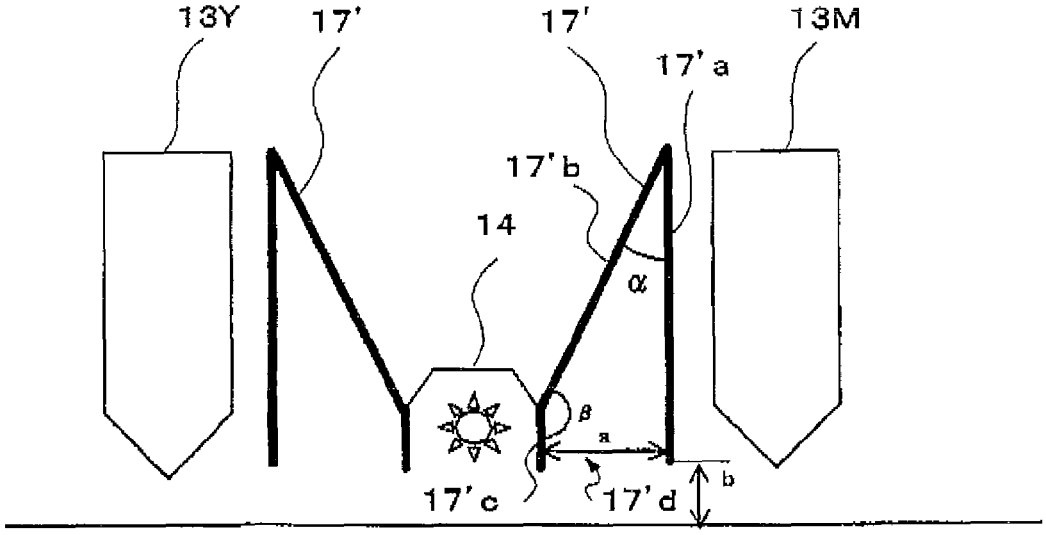

$\theta/16 \leqq \alpha \leqq \theta/(n-2)$, $\tan\theta = 2b/a$ $\beta = 180° - \alpha$ THE VALUE OF n ($1 \leqq N \leqq 15$) DEPENDS ON THE SENSITIVITY OF THE INK, THE INTENSITY OF THE LIGHT SOURCE, AND THE UV REFLECTIVITY OF THE INNER FACE OF THE LIGHT CAPTURING PORTION

FIG. 4

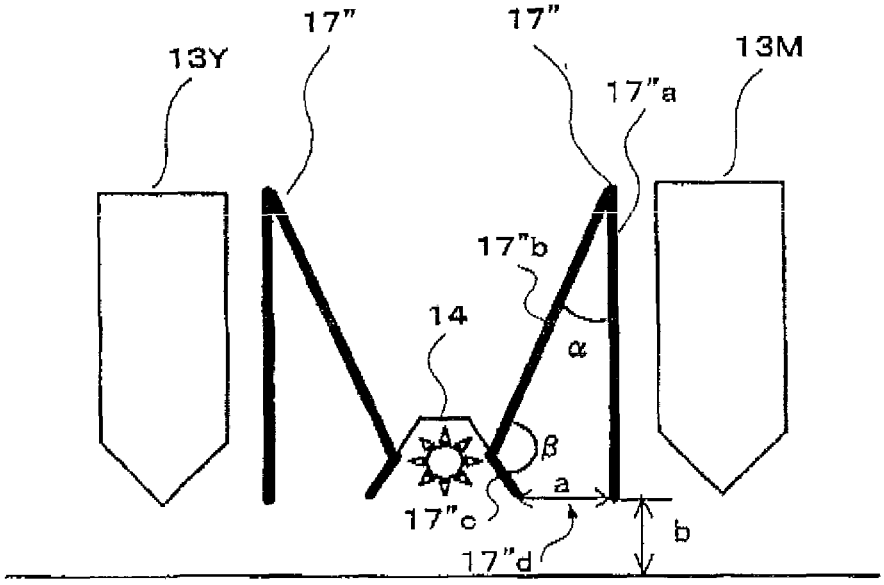

$90° \leqq \beta \leqq 180° - \alpha$ $\theta/16 \leqq \alpha \leqq (2\beta - \theta)/(n-3)$, $\tan\theta = 2b/a$ THE VALUE OF n ($1 \leqq N \leqq 15$) DEPENDS ON THE SENSITIVITY OF THE INK, THE INTENSITY OF THE LIGHT SOURCE, AND THE UV REFLECTIVITY OF THE INNER FACE OF THE LIGHT CAPTURING PORTION

UV CURABLE INK-JET RECORDING APPARATUS

FIELD OF THE INVENTION

The present invention relates to an ink-jet apparatus in which an ink is ejected onto a recording medium by an ink-jet head to form an image, and more particularly to an ink-jet recording apparatus in which stray light can be captured.

BACKGROUND OF THE INVENTION

An ink-jet apparatus in which an ink that can be cured by an active energy ray such as a UV ray (ultraviolet ray) or an electron beam is ejected onto a recording medium with using an ink-jet head, and the ink is cured by active-ray irradiation to form an image has features such as that it is environmentally friendly, and that it can obtain a high-resolution image which can be recorded at a high speed on various recording media, and which hardly bleeds. Particularly, development of an apparatus which uses a UV curable ink is advancing from the viewpoints of easy handling of a light source, compactness, and the like. By taking the advantage of the high-speed fixing property, a so-called single-pass ink-jet apparatus has been proposed in which a web-like recording medium that can be transported at a high speed is used, a head having a width that allows recording to be performed over the whole width of the recording medium is placed so as to be opposed to the recording medium in a state where the head is fixed, and recording is completed simply by causing the recording medium to pass under the head one time. In the case where color printing is performed by using such a single-pass ink-jet apparatus, stationary heads the number of which is equal to that of colors are arranged in the direction of transporting the recording medium. In order to prevent different colors from being mixed with each other in this case, an apparatus in which light irradiating means is placed downstream of each of the heads of the respective colors is disclosed (see JP-A-2004-314586).

On the other hand, in an apparatus having a high productivity, when a web-like recording medium is transported at a high speed, transport wobbling of a base member occurs, and the image quality is reduced. Therefore, an image forming portion must be shortened, and the ink-jet head and the UV irradiating unit are placed in proximity to each other. In this case, there is a possibility that a UV ray which is emitted from the light source, or that which is emitted from the light source and reflected from the surface of the recording medium enters a nozzle face, and inks on the nozzle face and in the vicinities of ejection ports react with UV light to be thickened or cured, thereby causing nozzle clogging or an ejection failure. In order to reduce the quantity of a UV ray entering a nozzle face, an apparatus in which a light trap for capturing a UV ray is disposed between a recording head and a UV irradiating unit is disclosed (see JP-A-2004-167717).

The light trap disclosed in JP-A-2004-167917 is employed in an apparatus of the carriage type. FIG. 5 shows an ink-jet apparatus in which this concept is applied to the single-pass ink-jet system, and which is a premise of the invention. Although the invention will be described with respect to an example of a single-pass ink-jet apparatus, the invention is not restricted to this.

In FIG. 5, 40 denotes the single-pass ink-jet apparatus. In the single-pass ink-jet apparatus 40, the recording medium S is taken out from a recording medium roll 41 which is wound in a roll. First, during when the recording medium S is transported under a full-line ink-jet head 43Y for Y (yellow) color in which many ink-jet nozzles are arranged in the width direction of the recording medium S, a Y-color ink is ejected onto the recording medium S no as to form a desired image. Immediately after the ejection, the recording medium S is passed under a UV irradiation lamp 44. During the passage, the Y-color ink which is a UV curable ink, and which is ejected onto the recording medium S is exposed to UV light to be subjected to semi-curing.

Next, during when the recording medium S is transported under a full-line ink-jet head 43M for M (magenta) color in which many ink-jet nozzles are arranged in the width direction of the recording medium S, an M-color UV curable ink is ejected onto the recording medium S so as to form a desired image. Immediately after the ejection, the recording medium S is passed under a similar UV irradiation lamp 44. During the passage, the M-color ink which is ejected onto the recording medium S is exposed to UV light to be subjected to semi-curing.

Then, during when the recording medium S is transported under a full-line ink-jet head 43C for C (cyan) color in which many ink-jet nozzles are arranged in the width direction of the recording medium S, a C-color UV curable ink is ejected onto the recording medium S so as to form a desired image. Immediately after the ejection, the recording medium S is passed under a similar UV irradiation lamp 44. During the passage, the C-color ink which is ejected onto the recording medium S is exposed to UV light to be subjected to semi-curing.

Finally, during when the recording medium S is transported under a full-line ink-jet head 43B for B (black) color in which many ink-jet nozzles are arranged in the width direction (the direction perpendicular to the plane of the figure) of the recording medium S, a B-color UV curable ink is ejected onto the recording medium S so as to form a desired image. Immediately after the ejection, the recording medium S is passed under a metal halide lamp 45 which is higher in light intensity than the above UV irradiation lamps 44. During the passage, the four-color inks are exposed to UV light to be fixed, thereby completing recording using the four-color inks.

For the purpose of improving the productivity, enhancements of the sensitivity of an ink and the energy or a UV irradiation tamp are attempted.

On the other hand, on the lower face of each of the ink-jet heads 43, the ink is easily cured by leakage light from the UV irradiation lamps 44. In order to allow the ink-jet head 43 to stably perform the ink jet ejection for a long term, in the apparatus of FIG. 5, a light capturing portion 47 is interposed between the ink-jet head 43 and the UV irradiation lamp 44, so that leakage light from the UV irradiation lamp 44 does not reach the ink-jet head 43.

SUMMARY OF THE INVENTION

The light capturing portion 47 in FIG. 5 can prevent leakage light from the UV irradiation lamp 44 from reaching the ink-jet head 43. When the ink-jet head 43 was checked after a long-term use, however, it was noted that slight ink curing occurs at the tip end of the head.

A study of the cause of this has revealed that the ink curing is caused by so-called "reflected light" which is first emitted from the UV irradiation lamp 44 to advance to the recording medium S and then reflected therefrom to reach the ink-jet head 43.

As described above, the method using the light capturing portion 47 of FIG. 5 is insufficient tin completely suppress curing of an ink adhering to the tip end of the head, and stably perform the ink jet ejection for a long term.

The invention has been conducted in order to solve these problems. It is an object of the invention to provide an ink-jet recording apparatus in which curing of an ink adhering to the tip end of a head can be suppressed by simple means, and which has a high productivity, can perform printing on various recording media, is compact, and can be stably used.

(1) In order to attain the object, the UV curable ink-jet recording apparatus of the invention is an apparatus including: a recording medium transporting unit for transporting a recording medium; an ink-jet head which, on the basis of an image signal, ejects an ink that is curable by UV irradiation, toward the recording medium transported by the recording medium transporting unit; and a UV irradiating unit for curing the ink which is ejected onto the recording medium by the ink-jet head, wherein the apparatus comprises a light capturing portion between the UV irradiating unit and the ink-jet head, at least a part of the light capturing portion as seen in a longitudinal section taken vertically along a direction of transporting the recording medium has an opened wedge shape having no base side and comprising: a side vertical to the recording medium; and an oblique side which is in contact with a top of the vertical side, and which extends obliquely downward, the vertical side is located on the side of the ink-jet head, and the oblique side downward extends from the top toward the UV irradiating unit. The term "UV" (ultraviolet ray) as used herein includes, into its meaning, visible ray of short-wavelength region (450 nm or less).

(2) In the UV curable ink-jet recording apparatus of (1), when a distance between both lower ends of an opening of the wedge-shaped light capturing portion in the direction of transporting the recording medium is a, a gap between the recording medium and the lower ends of the light capturing portion is b, and $\tan\theta=2b/a$, an opening angle of the wedge shape is $\alpha\leqq\theta/2$, and an angle $\beta$ formed by the oblique side of the wedge shape and a light shielding side which shields the UV irradiating unit is $90°<\beta\leqq180°$.

(3) In the UV curable ink-jet recording apparatus of (1) or (2), an inside of the light capturing portion is configured by a material which has a UV reflectivity of 50% or less.

According to the configuration, it is possible to obtain an ink-jet recording apparatus in which also both leakage light and reflected light are trapped by simple means to completely suppress ink curing, and which has a high productivity, can perform printing on various recording media, is compact, and can be stably used.

BRIEF DESCRIPTION OF THE DRAWINGS

FIG. 3 is a front schematic view of the vicinity of a head unit in Embodiment 2 of the invention.

FIG. 4 is a front schematic view of the vicinity of a head unit in Embodiment 3 of the invention.

DESCRIPTION OF REFERENCE NUMERALS AND SIGNS

Figure 1:
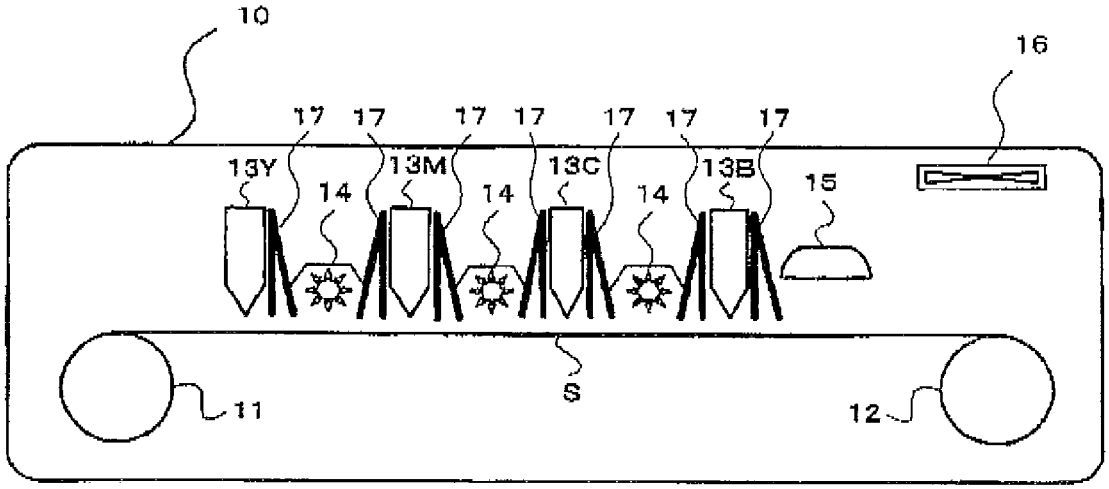
FIG. 1 is a diagram of a UV curable ink-jet recording apparatus of the invention.

10 UV curable ink-jet recording apparatus
11, 12 recording medium roll
13 (Y, M, C, K) ink-jet head
14 UV irradiation lamp
15 metal halide lamp
16 ventilation fan
17 light capturing portion in Embodiment 1
17*a* vertical side
17*b* oblique side
17*c* light shielding side
17' light capturing portion in Embodiment 2
17'*a* vertical side
17'*b* oblique side
17'*c* light shielding side
17" light capturing portion in Embodiment 3
17"*a* vertical side
17"*b* oblique side
17"*c* light shielding side
S recording medium
b gap between recording medium S and lower ends of light capturing portion 17
$\theta$ $\tan^{-1}[b/(a/2)]$
$\beta$ angle formed by oblique side and light shielding side

DETAILED DESCRIPTION OF THE INVENTION

Hereinafter, the invention will be described in detail with reference to the accompanying drawings.

Embodiment 1

FIG. 1 is a diagram of a UV curable ink-jet recording apparatus of Embodiment 1 of the invention. In FIG. 1, 10 denotes a single-pass ink-jet apparatus.

In the single-pass ink-jet apparatus 10, the recording medium S is taken out from a recording medium roll 11 which is wound in a roll. First, during when the recording medium S is transported under a full-line ink-jet head 13Y for Y (yellow) color in which many ink-jet nozzles are arranged in the width direction of the recording medium S, a Y-color ink is ejected onto the recording medium S so as to form a desired image. Immediately after the ejection, the recording medium S is passed under a UV irradiation lamp 14. During the passage, the Y-color ink which is a UV curable ink, and which is ejected onto the recording medium S is exposed to UV light to be subjected to semi-curing.

Next, during when the recording medium S is transported under a full-line ink-jet head 13M for M (magenta) color in which many ink-jet nozzles are arranged in the width direction of the recording medium S, an M-color UV curable ink is ejected onto the recording medium S so as to form a desired image. Immediately after the ejection, the recording medium S is passed under a similar UV irradiation lamp 14. During the passage, the M-color ink which is ejected onto the recording medium S is exposed to UV light to be subjected to semi-curing.

Then, during when the recording medium S is transported under a full-line ink-jet head 13C for C (cyan) color in which many ink-jet nozzles are arranged in the width direction of the recording medium S, a C-color UV curable ink is ejected onto the recording medium S so as to form a desired image. Immediately after the ejection, the recording medium S is passed under a UV irradiation lamp 14. During the passage, the C-color ink which is ejected onto the recording medium S is exposed to UV light to be subjected to semi-curing.

Finally, during when the recording medium S is transported under a full-line ink-jet head 13B for B (black) color in which many ink-jet nozzles are arranged in the width direction (the direction perpendicular to the plane of the figure) of the recording medium S, a B-color ink is ejected onto the recording medium S so as to form a desired image. Immediately after the ejection, the recording medium S is passed under a metal halide lamp 15 which is higher in light intensity than the above UV irradiation lamps 14. During the passage, the four-color inks are exposed to UV light to be fixed, thereby completing recording using the four-color inks.

In FIG. 1, 17 denotes light capturing portions in Embodiment 1. Each of the light capturing portions 17 has an "inverted V" shape in the figure. The "inverted V" shape provides a configuration in which light that once enters the inside from the opening of the inverted V shape, and that includes not only leakage light from the UV irradiation lamp 14 but also reflected light cannot be again reflected and returned therefrom. Therefore, an ink adhering to the ink-jet head 13 is not cured, so that curing of such an ink is completely suppressed, and the ink jet ejection can be stably performed for a long term.

Figure 2:
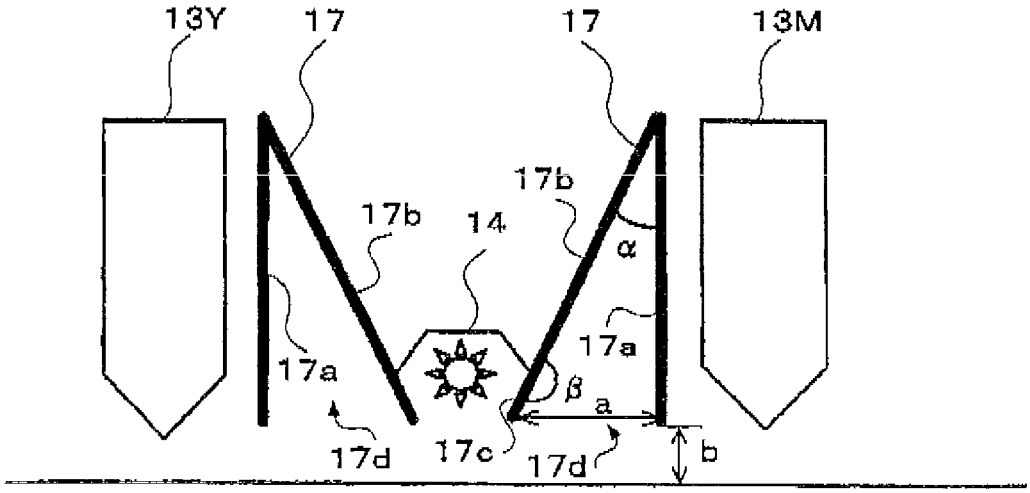
FIG. 2 is a front schematic view of the vicinity of a head unit in Embodiment 1 of the invention.
Figure 5:
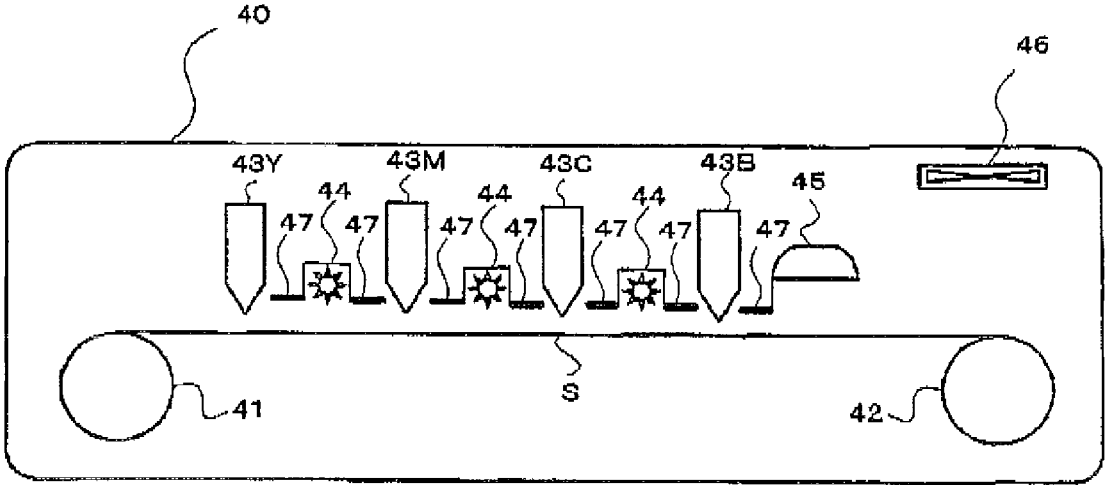
FIG. 5 is a diagram of a UV curable ink-jet recording apparatus which is a premise of the invention.

FIG. 2 is an enlarged sectional view illustrating the function of the light capturing portion 17 in FIG. 1.

Referring to FIG. 2, the light capturing portions 17 are disposed respectively between the UV irradiation lamp 14 and the ink-jet heads 13Y, 13M. In a longitudinal section (a section taken parallel to the plane of the figure) taken vertically along the transportation direction of the recording medium S, each of the light capturing portions 17 has an wedge (inverted V) shape comprising: a side 17*a* vertical to the recording medium S; an oblique side 17*b* which is in contact with the top of the vertical side 17*a*, and which extends obliquely downward; and a light shielding side 17*c* which is in contact with the lower end of the oblique side 17*b*, having no base side, and forming an opening 17*d*. Between the UV irradiation lamp 14 and the ink-jet head 13, the vertical side 17*a* is located on the side of the ink-jet head 13, and the oblique side 17*b* downward extends from the top toward the UV irradiation lamp 14.

The following is attained:

$$\tan\theta = b/(a/2)$$

where a is the distance between the both lower ends of the wedge shaped light capturing portion 17 in the direction of transporting the recording medium, and b is the gap between the recording medium S and the lower ends of the light capturing portion 17.

The angle β formed by the oblique side of the wedge shape and the light shielding side which shields the light source is set to β=180°.

Results of experiments which were conducted on the basis of Embodiment 1 of FIG. 2 are shown in Tables 1 and 2.

The major wavelength region of the light source used in the experiments was from 230 nm to 450 nm, and its peak wavelength was 365 nm. The same light source was used also in the following other experiments and Embodiments.

Table 1 shows combination examples of the apex angle α of the light capturing portion and the UV reflectivity with respect to inks having different sensitivities.

The experiments were conducted in the following manner. Three kinds of inks, or normal ink 1, high-sensitivity ink 2, and high-sensitivity ink 3 were used, and the speeds at which recording can be performed were sequentially set to 10 m/min., 20 m/min., and 50 m/min. The apex angle α was set to θ/3 to θ/15, the UV reflectivity of the inside of the light capturing portion was changed to 10% to 60%. The state of nozzle clogging was evaluated in three grades of ○○ (when maintenance was performed once a day, nozzle clogging due to ink curing did not occur), ○ (when maintenance was performed once a hour, nozzle clogging due to ink curing did not occur), and x (nozzle clogging occurred).

As a result, Table 1 was obtained.

TABLE 1

Combination examples of α of light capturing portion and UV reflectivity with respect to inks having different sensitivities

| Kind of ink | Recordable speed | α | UV reflectivity | Nozzle clogging |
|---|---|---|---|---|
| 1 | 10 m/min. | θ/3 | 10% | X |
| | | θ/4 | 10% | ○ |
| | | θ/5 | 20% | ○ |
| | | | 10% | ○○ |
| | | θ/13 | 50% | ○ |
| | | θ/15 | 60% | X |
| 2 high-sensitivity ink | 20 m/min. | θ/4 | 10% | X |
| | | θ/5 | 10% | ○ |
| | | θ/7 | 20% | ○ |
| | | θ/12 | 40% | ○ |
| | | θ/15 | 60% | X |
| 3 high-sensitivity ink | 50 m/min. | θ/5 | 10% | X |
| | | θ/6 | 10% | ○ |

Notes
X: nozzle clogging occurred,
○: when maintenance was performed once a hour, nozzle clogging due to ink curing did not occur, and
○○: when maintenance was performed once a day, nozzle clogging due to ink curing did not occur.

As seen from Table 1, as the apex angle α is smaller, nozzle clogging less occurs, and, as the UV reflectivity is smaller, nozzle clogging less occurs, and, as the ink sensitivity is lower, nozzle clogging less occurs.

Table 2 shows combination examples of the apex angle α of the light capturing portion and the UV reflectivity with respect to lights sources having different intensities.

The experiments were conducted in the following manner. Three kinds of lights sources each having a major wavelength region of from 230 nm to 450 nm and a peak wavelength of 365 nm as mentioned above, and respectively having strong (1500 mW/cm$^2$), medium (300 mW/cm$^2$), and low (50 mW/cm$^2$) light intensities were used, and the speeds at which recording can be performed were sequentially set to 10 m/min., 20 m/min., and 50 m/min. The apex angle α was set to θ/3 to θ/15, the UV reflectivity of the inside of the light capturing portion 17 was changed to 10% to 60%. The state of nozzle clogging was evaluated in three grades of ○○, ○ and x.

Also in the following descriptions with regard to the other Embodiments and results of experiments, the phrases "strong", "medium" and "low" used for light intensity mean "1500 mW/cm$^2$", "300 mW/cm$^2$" and "50 mW/cm$^2$" respectively.

As a result, Table 2 was obtained.

TABLE 2

Combination examples of α of light capturing portion and UV reflectivity with respect to lights sources having different intensities

| Kind of light source | Recordable speed | α | UV reflectivity | Nozzle clogging |
|---|---|---|---|---|
| weak | 10 m/min. | θ/3 | 10% | X |
| | | θ/4 | 10% | ○ |
| | | θ/5 | 20% | ○ |
| | | | 10% | ○○ |
| | | θ/13 | 50% | ○ |
| | | θ/15 | 60% | X |
| medium | 20 m/min. | θ/4 | 10% | X |
| | | θ/5 | 10% | ○ |
| | | θ/7 | 20% | ○ |
| | | θ/12 | 40% | ○ |
| | | θ/15 | 60% | X |

TABLE 2-continued

Combination examples of α of light capturing portion and UV reflectivity with respect to lights sources having different intensities

| Kind of light source | Recordable speed | α | UV reflectivity | Nozzle clogging |
|---|---|---|---|---|
| strong | 50 m/min. | θ/5 | 10% | X |
| | | θ/6 | 10% | ○ |

Notes
X: nozzle clogging occurred,
○: when maintenance was performed once a hour, nozzle clogging due to ink curing did not occur, and
○○: when maintenance was performed once a day, nozzle clogging due to ink curing did not occur.

As seen from Table 2, as the apex angle α is smaller, nozzle clogging less occurs, and, as the UV reflectivity is smaller, nozzle clogging less occurs, and, as the light intensity is lower, nozzle clogging less occurs.

In Embodiment 1, it has been noted that, when the light capturing portion 17 is configured so that the opening angle α of the wedge shape is $\theta/16 \leqq \alpha \leqq \theta/n$ (where $1 \leqq n \leqq 15$) and β is 180 deg., ink clogging does not occur. The value of n can be adequately determined within the above range in accordance with the sensitivity of the ink, the intensity of the light source, and the UV reflectivity of the inner face of the light capturing portion.

Furthermore, it has been noted that, when the inside of the capturing portion 17 is configured by a material having a UV reflectivity of 50% or less, reflected light which has once entered the inside is attenuated by repeating internal reflections and cannot leave the inside of the capturing portion 17. Conversely, it has been noted that, when the UV reflectivity is larger than 50%, reflected light which has once entered the inside of the capturing portion 17 leaves the inside as a result of repeated internal reflections, and is formed as stray light to reach the nozzles.

Embodiment 2

FIG. 3 is a sectional view illustrating the function of a light capturing portion 17' in Embodiment 2 of the invention. Referring to FIG. 3, the light capturing portion 17' is disposed between the UV irradiation lamp 14 and each of the ink-jet heads 13. In a longitudinal section (a section taken parallel to the plane of the figure) taken vertically along the transportation direction of the recording medium S, the light capturing portions 17' has an wedge (inverted V) shape comprising: a side 17'*a* vertical to the recording medium S; an oblique side 17'*b* which is in contact with the top of the vertical side 17'*a*, and which extends obliquely downward; and a light shielding side 17'*c* which is in contact with the lower end of the oblique side 17'*b*, and which extends vertically downward, having no base side, and forming an opening 17'*d*. When the distance between the both lower ends of the wedge-shaped light capturing portion 17' in the direction of transporting the recording medium is a, the gap between the recording medium S and the lower ends of the light capturing portion 17' is b, and $\tan\theta = 2b/a$, the angle β formed by the oblique side of the wedge shape and the light shielding side 17'C which shields the light source is set to $\beta = 180° - \alpha$.

Results of experiments which were conducted on the basis of Embodiment 2 of FIG. 3 are shown in Tables 3 and 4.

Table 3 shows combination examples of the apex angle α of the light capturing portion and the UV reflectivity with respect to inks having different sensitivities.

The experiments were conducted in the following manner. Three kinds of inks, or normal ink 1, high-sensitivity ink 2, and high-sensitivity ink 3 were used, and the speeds at which recording can be performed were sequentially set to 10 m/min., 20 m/min., and 50 m/min. The apex angle α was set to θ/3 to θ/15, the UV reflectivity of the inside of the light capturing portion was changed to 10% to 60%. The state of nozzle clogging was evaluated in three grades of ○○, ○, and x.

As a result, Table 3 was obtained,

TABLE 3

Combination examples of α of light capturing portion and UV reflectivity with respect to inks having different sensitivities

| Kind of ink | Recordable speed | α | UV reflectivity | Nozzle clogging |
|---|---|---|---|---|
| 1 | 10 m/min. | θ | 10% | X |
| | | θ/2 | 10% | ○ |
| | | θ/3 | 20% | ○ |
| | | | 10% | ○○ |
| | | θ/11 | 50% | ○ |
| | | θ/15 | 60% | X |
| 2 high-sensitivity ink | 20 m/min. | θ/2 | 10% | X |
| | | θ/3 | 10% | ○ |
| | | θ/5 | 20% | ○ |
| | | θ/14 | 50% | ○ |
| | | θ/15 | 60% | X |
| 3 high-sensitivity ink | 50 m/min. | θ/3 | 10% | X |
| | | θ/4 | 10% | ○ |

Notes
X: nozzle clogging occurred,
○: when maintenance was performed once a hour, nozzle clogging due to ink curing did not occur, and
○○: when maintenance was performed once a day, nozzle clogging due to ink curing did not occur.

As seen from Table 3, as the apex angle α is smaller, nozzle clogging less occurs, and, as the UV reflectivity is smaller, nozzle clogging less occurs, and, as the ink sensitivity is lower, nozzle clogging less occurs.

Furthermore, various experiments revealed that, when the inside of the capturing portion 17' is configured by a material having a UV reflectivity of 50% or less, reflected light which has once entered the inside is attenuated by repeating internal reflections and cannot leave the inside of the capturing portion 17'.

Table 4 shows combination examples of the apex angle α of the light capturing portion and the UV reflectivity with respect to lights sources having different intensities.

The experiments were conducted in the following manner. Three kinds of lights sources, or light sources respectively having strong, medium, and low light intensities were used, and the speeds at which recording can be performed were sequentially set to 10 m/min., 20 m/min., and 50 m/min. The apex angle α was set to θ/3 to θ/15, the UV reflectivity of the inside of the light capturing portion was changed to 10% to 60%. The state of nozzle clogging was evaluated in three grades of ○○, ○ and x.

As a result, Table 4 was obtained

TABLE 4

Combination examples of α of light capturing portion and UV reflectivity with respect to lights sources having different intensities

| Kind of light source | Recordable speed | α | UV reflectivity | Nozzle clogging |
|---|---|---|---|---|
| weak | 10 m/min. | θ | 10% | X |
| | | θ/2 | 10% | ○ |
| | | θ/3 | 20% | ○ |
| | | | 10% | ○○ |

TABLE 4-continued

Combination examples of α of light capturing portion and UV reflectivity with respect to lights sources having different intensities

| Kind of light source | Recordable speed | α | UV reflectivity | Nozzle clogging |
|---|---|---|---|---|
| | | θ/11 | 50% | ○ |
| | | θ/15 | 60% | X |
| medium | 20 m/min. | θ/2 | 10% | X |
| | | θ/3 | 10% | ○ |
| | | θ/5 | 20% | ○ |
| | | θ/14 | 50% | ○ |
| | | θ/15 | 60% | X |
| strong | 50 m/min. | θ/3 | 10% | X |
| | | θ/4 | 10% | ○ |

Notes

X: nozzle clogging occurred,

○: when maintenance was performed once a hour, nozzle clogging due to ink curing did not occur, and ○○: when maintenance was performed once a day, nozzle clogging due to ink curing did not occur.

As seen from Table 4, as the apex angle α is smaller, nozzle clogging less occurs, and, as the UV reflectivity is smaller, nozzle clogging less occurs, and, as the light intensity is lower, nozzle clogging less occurs.

In Embodiment 2, it has been noted that, when the light capturing portion 17' is configured so that the opening angle α of the wedge shape is $\theta/16 \leqq \alpha \leqq \theta/(n-2)$ (where $1 \leqq n \leqq 15$) and β is 180−α deg., ink clogging does not occur. The value of n can be adequately determined within the above range in accordance with the sensitivity of the ink, the intensity of the light source, and the UV reflectivity of the inner face of the light capturing portion.

Furthermore, it has been noted that, when the inside of the capturing portion 17' is configured by a material having a UV reflectivity of 50% or less, reflected light which has once entered the inside is attenuated by repeating internal reflections and cannot leave the inside of the capturing portion 17'. Conversely, it has been noted that, when the UV reflectivity is larger than 50%, reflected light which has once entered the inside of the capturing portion 17' leaves the inside as a result of repeated internal reflections, and is formed as stray light to reach the nozzles.

Embodiment 3

FIG. 4 is a sectional view illustrating the function of a light capturing portion 17" in Embodiment 3 of the invention. Referring to FIG. 4, the light capturing portion 17" is disposed between the UV irradiation lamp 14 and each of the ink-jet heads 13. In a longitudinal section (a section taken parallel to the plane of the figure) taken vertically along the transportation direction of the recording medium S, the light capturing portions 17" has an wedge (inverted V) shape comprising: a side 17"*a* vertical to the recording medium S; an oblique side 17"*b* which is in contact with the top of the vertical side 17"*a*, and which extends obliquely downward; and a light shielding side 17"*c* which is in contact with the lower end of the oblique side 17"*b*, and which extends obliquely inward, having no base side, and forming an opening 17"*d*.

When the distance between the both lower ends of the wedge-shaped light capturing portion 17" in the direction of transporting the recording medium is a, the gap between the recording medium S and the lower ends of the light capturing portion 17" is b, and $\tan\theta = 2b/a$, the opening angle α of the wedge shape is $\theta/16 \leqq \alpha \leqq (2\beta-\theta)/(n-3)$ (where the definition of n is identical with that in Embodiment 1), and β is 90° C.$\leqq \beta \leqq$ 180°−α.

Results of experiments which were conducted on the basis of Embodiment 3 of FIG. 4 are shown in Tables 5 and 6.

Table 5 shows combination examples of the apex angle α of the light capturing portion and the UV reflectivity with respect to inks having different sensitivities.

The experiments were conducted in the following manner. Three kinds of inks, or normal ink 1, high-sensitivity ink 2, and high-sensitivity ink 3 were used, and the speeds at which recording can be performed were sequentially set to 10 m/min., 20 m/min., and 50 m/min. The apex angle α was set to (2β−θ) to (2β−θ)/15, the UV reflectivity of the inside of the light capturing portion was changed to 10% to 60%. The state of nozzle clogging was evaluated in three grades of ○○, ○, and x.

As a result, Table 5 was obtained.

TABLE 5

Combination examples of α of light capturing portion and UV reflectivity with respect to inks having different sensitivities

| Kind of ink | Recordable speed | α | UV reflectivity | Nozzle clogging |
|---|---|---|---|---|
| 1 | 10 m/min. | 2β − θ | 20% | X |
| | | (2β − θ)/2 | 10% | ○ |
| | | (2β − θ)/3 | 20% | ○ |
| | | | 10% | ○○ |
| | | (2β − θ)/11 | 50% | ○ |
| | | (2β − θ)/15 | 60% | X |
| 2 high-sensitivity ink | 20 m/min. | 2β − θ | 10% | X |
| | | (2β − θ)/2 | 10% | ○ |
| | | (2β − θ)/4 | 20% | ○ |
| | | (2β − θ)/13 | 50% | ○ |
| | | (2β − θ)/15 | 60% | X |
| 3 high-sensitivity ink | 50 m/min. | (2β − θ)/3 | 10% | X |
| | | (2β − θ)/4 | 10% | ○ |

Notes

X: nozzle clogging occurred,

○: when maintenance was performed once a hour, nozzle clogging due to ink curing did not occur, and ○○: when maintenance was performed once a day, nozzle clogging due to ink curing did not occur.

As seen from Table 5, as the apex angle α is smaller, nozzle clogging less occurs, and, as the UV reflectivity is smaller, nozzle clogging less occurs, and, as the ink sensitivity is lower, nozzle clogging less occurs.

The value of β is limited to 90 deg. in FIG. 4. When β is smaller than this value, light from the light source hardly enters the inside of the light capturing portion 17" as seen from the figure. Therefore, this case is not preferable.

Table 6 shows combination examples of the apex angle α of the light capturing portion and the UV reflectivity with respect to lights sources having different intensities.

The experiments were conducted in the following manner. Three kinds of lights sources, or light sources respectively having strong, medium, and low light intensities were used, and the speeds at which recording can be performed were sequentially set to 10 m/min., 20 m/min., and 50 m/min. The apex angle α was set to (2β−θ) to (2β−θ)/15, the UV reflectivity of the inside of the light capturing portion was changed to 10% to 60%. The state of nozzle clogging was evaluated in three grades of ○○, ○ and x.

As a result, Table 6 was obtained.

TABLE 6

Combination examples of α of light capturing portion and UV reflectivity with respect to lights sources having different intensities

| Kind of ink | Recordable speed | α | UV reflectivity | Nozzle clogging |
|---|---|---|---|---|
| weak | 10 m/min. | 2β − θ | 20% | X |
| | | (2β − θ)/2 | 10% | ○ |
| | | (2β − θ)/3 | 20% | ○ |
| | | | 10% | ○○ |
| | | (2β − θ)/11 | 50% | ○ |
| | | (2β − θ)/15 | 60% | X |
| medium | 20 m/min. | 2β − θ | 10% | X |
| | | (2β − θ)/2 | 10% | ○ |
| | | (2β − θ)/4 | 20% | ○ |
| | | (2β − θ)/13 | 50% | ○ |
| | | (2β − θ)/15 | 60% | X |
| strong | 50 m/min. | (2β − θ)/3 | 10% | X |
| | | (2β − θ)/4 | 10% | ○ |

Notes

X: nozzle clogging occurred,

○: when maintenance was performed once a hour, nozzle clogging due to ink curing did not occur, and ○○: when maintenance was performed once a day, nozzle clogging due to ink curing did not occur.

As seen from Table 6, as the apex angle α is smaller, nozzle clogging less occurs, and, as the UV reflectivity is smaller, nozzle clogging less occurs, and, as the light intensity is lower, nozzle clogging less occurs.

The value of β is limited to 90 deg. in FIG. 4. When β is smaller than this value, light from the light source hardly enters the inside of the light capturing portion 17" as seen from the figure. Therefore, this case is not preferable.

As a result of the above, it was noted that, when the shape of the light capturing portion 17" of FIG. 4 is satisfied, the quantity of UV light reaching the nozzle face of the head can be surely reduced.

Furthermore, it has been noted that, when the inside of the capturing portion 17" is configured by a material having a UV reflectivity of 50% or less, reflected light which has once entered the inside is attenuated by repeating internal reflections and cannot leave the inside of the capturing portion 17". Conversely, it has been noted that, when the UV reflectivity is larger than 50%, reflected light which has once entered the inside of the capturing portion 17" leaves the inside as a result of repeated internal reflections, and is formed as stray light to reach the nozzles.

As described above, it has been noted that, according to the light capturing portion in the invention, also both leakage light and reflected light are trapped by simple means to completely suppress ink curing, and the recording apparatus has a high productivity, can perform printing on various recording media, is compact, and can be stably used.

The "UV light" (UV) as used in the present invention is not particularly limited as long as its irradiation can impart energy capable of generating an initiation species in the ink composition (active energy ray). And, the active energy ray widely includes α-ray, γ-ray, X-ray, ultraviolet ray, visible ray, electron beam and the like. Among these, in view of curing sensitivity and easy availability of the apparatus, ultraviolet ray, visible ray and electron beam are preferred, and ultraviolet ray and visible ray of short-wavelength region (450 nm or less) are more preferred. Accordingly, the ink composition for use in the present invention is preferably an ink composition which can be cured by the irradiation of ultraviolet ray or visible ray of short-wavelength region (450 nm or less).

In the ink-jet recording apparatus of the present invention, the peak wavelength of active energy ray varies depending on the absorption characteristics of the sensitizing dye in the ink composition but is suitably, for example, from 200 to 600 nm, preferably from 300 to 450 nm, more preferably from 350 to 450 nm. Also, the (a) electron transfer-type initiation system of the ink composition for use in the present invention exhibits sufficiently high sensitivity even for low-output UV light. Accordingly, the output of the UV light used as the irradiation energy is suitably, for example, 2,000 mJ/cm$^2$ or less, preferably from 10 to 2,000 mJ/cm$^2$, more preferably from 20 to 1,000 mJ/cm$^2$, still more preferably from 50 to 800 mJ/cm$^2$. Also, the UV light is suitably irradiated at an exposure surface illuminance (a maximum illuminance on the recording medium surface) of, for example, from 10 to 2,000 mW/cm$^2$ preferably from 20 to 1,000 mW/cm$^2$.

Particularly, in the ink-jet recording apparatus of the present invention, the UV light is preferably irradiated from a light-emitting diode which can generate an ultraviolet ray or visible ray of the short-wavelength region, having an emission wavelength peak of 390 to 420 nm and giving a maximum illuminance of 10 to 1,000 mW/cm$^2$ on the recording medium surface.

Also, in the ink-jet recording apparatus of the present invention, the UV light suitably irradiates the ink composition ejected on a recording medium, for example, for 0.01 to 120 seconds, preferably from 0.1 to 90 seconds.

Furthermore, in the ink-jet recording apparatus of the present invention, it is preferred that the ink composition is heated to a fixed temperature and the time from the landing of ink composition on a recording medium to the irradiation of UV light is set to 0.01 to 0.5 seconds, preferably from 0.02 to 0.3 seconds, more preferably from 0.03 to 0.15 seconds. By virtue of controlling the time from the landing of ink composition on a recording medium to the irradiation of UV light to such a very short time, the ink composition landed can be prevented from bleeding before curing.

For obtaining a color image by using the ink-let recording apparatus of the present invention, the colors are preferably superposed in the color value order from lower to higher. When superposed in such an order, the UV light can readily reach the ink in the lower part and this can be expected to yield good curing sensitivity, reduction of residual monomer, decrease of odor and enhancement of adhesive property. As for the irradiation of UV light, all colors may be ejected and en bloc exposed, but exposure is preferably performed every each color in view of accelerating the curing.

As described above, in the case of UV-curable ink like the ink composition of the present invention, the ink composition elected is preferably kept at a constant temperature and therefore, the temperature in the region from the ink supply tank to the ink-jet head portion is preferably controlled by heat insulation and heating. Also, the head unit is preferably heated by thermally shielding or insulating the apparatus body so as not to receive an effect from the temperature of air. In order to shorten the printer start-up time necessary for heating or reduce the loss of heat energy, in combination with thermal insulation from other sites, the heat capacity of the entire heating unit is preferably made small.

As for the UV light source, a mercury lamp, a gas/solid laser, a hot-cathode tube and the like are principally utilized and for the ultraviolet curing-type ink-jet, a mercury lamp and a metal halide lamp are widely known. Furthermore, replacement by a GaN-based semiconductor ultraviolet light-emitting device is industrially and environmentally very useful. In addition, LED (UV-LED) and LD (UV-LD) are compact, long-lived, highly efficient and low costing and are promising as a radiation source for UV curing-type ink-jet.

As described above, a light-emitting diode (LED) and a laser diode (LD) can be used as the UV light source. In particular, when an ultraviolet source is necessary, an ultraviolet LED or an ultraviolet LD can be used. For example, an ultraviolet LED of which main emission spectrum has a wavelength between 365 nm and 420 nm is commercially available from Nichia Corp. Also, when a further shorter wavelength is required, an LED capable of emitting UV light having a primary emission between 300 nm and 370 nm in disclosed in U.S. Pat. No. 6,084,250. Other ultraviolet LEDs are also available, and radiations in different ultraviolet bands may be irradiated. The UV light source for use in the present invention is preferably UV LED, more preferably UV LED having a peak wavelength in the region of 350 to 420 nm.

[Recording Medium]

The recording medium to which the ink composition of the present invention can be applied is not particularly limited and normal paper sheets ouch as non-coated paper and coated paper, and various non-absorptive resin materials and resin films shaped therefrom, which are used in so-called soft packaging, may be used. Examples of various plastic films include PET film, OPS film, OPP film, ONy film, PVC film, PE film, TAC film and PP film. Other examples of the plastic usable as the recording medium material include polycarbonate, acrylic resin, ABS, polyacetal, PVA and rubbers. Furthermore, metals and glasses may also be used as the recording medium.

In the ink composition of the present invention, when a material less causing heat shrinkage at curing is selected, excellent adhesive property is obtained between the cured ink composition and the recording medium and this is advantageous in that a high definition image can be formed even on a film susceptible to curling or deformation due to, for example, curing shrinkage of ink or heat generation at the curing reaction, such as PET film, OPS film, OPP film, ONy film and PVC film which are thermally shrinkable.

The constituent components for use in the ink composition usable in the present invention are described below in sequence.

[Ink Composition]

The ink composition for use in the present invention is an ink composition capable of being cured by the irradiation of UV light, and examples thereof include a cationic polymerization-type ink composition, a radical polymerization-type ink composition and an aqueous ink composition. These compositions are described in detail below.

(Cationic Polymerization-Type Ink Composition)

The cationic polymerization-type ink composition contains (a) a cationic polymerizable compound, (b) a compound capable of generating an acid upon irradiation with active energy ray and (c) a colorant and if desired, may further contain an ultraviolet absorbent, a sensitizer, an antioxidant, a discoloration inhibitor, electrically conducting salts, a solvent, a polymer compound, a surfactant and the like.

The constituent components used in the cationic polymerization-type ink composition are described below in sequence.

[(a) Cationic Polymerizable Compound]

The (a) cationic polymerizable compound for use in the present invention is not particularly limited as long as it is a compound capable of being cured by causing a polymerization reaction using an acid generated from the (b) compound capable of generating an acid upon irradiation with active energy ray, and various known cationic polymerizable monomers known as a photo-cationic polymerizable monomer may be used. Examples of the cationic polymerizable monomer include epoxy compounds, vinyl ether compounds and oxetane compounds described in JP-A-6-9714, JP-A-2001-31892, JP-A-2001-40068, JP-A-2001-55507, JP-A-2001-310938, JP-A-2001-310937 and JP-A-2001-220526.

Examples of the epoxy compound include an aromatic epoxide, an alicyclic epoxide and an aliphatic epoxide.

The aromatic epoxide includes a di- or polyglycidyl ether produced by the reaction of a polyhydric phenol having at least one aromatic nucleus or an alkylene oxide adduct thereof with epichlorohydrin. Examples thereof include a di- or polyglycidyl ether of bisphenol A or an alkylene oxide adduct thereof, a di- or polyglycidyl ether of hydrogenated bisphenol A or an alkylene oxide adduct thereof, and a novolak-type epoxy resin. Examples of the alkylene oxide include an ethylene oxide and a propylene oxide.

As for the alicyclic epoxide, a cyclohexene oxide- or cyclopentene oxide-containing compound obtained by epoxidizing a compound having at least one cycloalkene ring such as cyclohexene or cyclopentene ring with an appropriate oxidizing agent such as hydrogen peroxide and peracid is preferred.

Examples of the aliphatic epoxide include a di- or polyglycidyl ether of an aliphatic polyhydric alcohol or an alkylene oxide adduct thereof. Representative examples thereof include a diglycidyl ether of an alkylene glycol, such as diglycidyl ether of ethylene glycol, diglycidyl ether of propylene glycol, and diglycidyl ether of 1,6-hexanediol; a polyglycidyl ether of a polyhydric alcohol, such as di- or triglycidyl ether of glycerin or an alkylene oxide adduct thereof; and a diglycidyl ether of a polyalkylene glycol, as represented by a diglycidyl ether of a polyethylene glycol or an alkylene oxide adduct thereof, and a diglycidyl ether of a polypropylene glycol or an alkylene oxide adduct thereof. Here, examples of the alkylene oxide include an ethylene oxide and a propylene oxide.

The epoxy compound may be monofunctional or polyfunctional.

Examples of the monofunctional epoxy compound which can be used in the present invention include phenyl glycidyl ether, p-tert-butylphenyl glycidyl ether, butyl glycidyl ether, 2-ethylhexyl glycidyl ether, allyl glycidyl ether, 1,2-butylene oxide, 1,3-butadiene monoxide, 1,2-epoxydodecane, epichlorohydrin, 1,2-epoxydecane, styrene oxide, cyclohexene oxide, 3-methacryloyloxymethylcyclohexene oxide, 3-acryloyloxymethylcyclohexene oxide and 3-vinylcyclohexene oxide.

Examples of the polyfunctional epoxy compound include bisphenol A diglycidyl ether, bisphenol F diglycidyl ether, bisphenol S diglycidyl ether, brominated bisphenol A diglycidyl ether, brominated bisphenol F diglycidyl ether, brominated bisphenol S diglycidyl ether, epoxy novolak resin, hydrogenated bisphenol A diglycidyl ether, hydrogenated bisphenol F diglycidyl ether, hydrogenated bisphenol S diglycidyl ether, 3,4-epoxycyclohexylmethyl-3',4'-epoxycyclohexane carboxylate, 2-(3,4-epoxycyclohexyl-5,5-spiro-3,4-epoxy)cyclohexane-meta-dioxane, bis(3,4-epoxycyclohexylmethyl) adipate, vinylcyclohexene oxide, 4-vinylepoxycyclohexane, bis(3,4-epoxy-6-methylcyclohexylmethyl) adipate, 3,4-epoxy-6-methylcyclohexyl-3',4'-epoxy-6'-methylcyclohexane carboxylate, methylenebis(3,4-epoxycyclohexane), dicyclopentadiene diepoxide, di(3,4-epoxycyclohexylmethyl)ether of ethylene glycol, ethylenebis(3,4-epoxycyclohexane carboxylate), dioctyl epoxyhexahydrophthalate, di-2-ethylhexyl epoxyhexahydrophthalate, 1,4-butanediol diglycidyl ether, 1,6-hexanediol diglycidyl ether, glycerin triglycidyl ether, trimethylolpropane triglycidyl ether, polyethylene glycol diglycidyl ether, polypropylene glycol diglycidyl ethers, 1,1,3-tetradecadiene dioxide, limonene dioxide, 1,2,7,8-diepoxyoctane and 1,2,5,6-diepoxycyclooctane.

Among these epoxy compounds, an aromatic epoxide and an alicyclic epoxide are preferred in view of excellent curing rate, and an alicyclic epoxide is more preferred.

Examples of the vinyl ether compound include a di- or trivinyl ether compound such as ethylene glycol divinyl ether, diethylene glycol divinyl ether, triethylene glycol divinyl ether, propylene glycol divinyl ether, dipropylene glycol divinyl ether, butanediol divinyl ether, hexanediol divinyl ether, cyclohexanedimethanol divinyl ether and trimethylolpropane trivinyl ether; and a monovinyl ether compound such as ethyl vinyl ether, n-butyl vinyl ether, isobutyl vinyl ether, octadecyl vinyl ether, cyclohexyl vinyl ether, hydroxybutyl vinyl ether, 2-ethylhexyl vinyl ether, cyclohexanedimethanol monovinyl ether, n-propyl vinyl ether, isopropyl vinyl ether, isopropenyl ether-O-propylene carbonate, dodecyl vinyl ether, diethylene glycol monovinyl ether and octadecyl vinyl ether.

The vinyl ether compound may be monofunctional or polyfunctional.

Specifically, examples of the monofunctional vinyl ether include methyl vinyl ether, ethyl vinyl ether, propyl vinyl ether, n-butyl vinyl ether, tert-butyl vinyl ether, 2-ethylhexyl vinyl ether, n-nonyl vinyl ether, lauryl vinyl ether, cyclohexyl vinyl ether, cyclohexylmethyl vinyl ether, 4-methylcyclohexylmethyl vinyl ether, benzyl vinyl ether, dicyclopentenyl vinyl ether, 2-dicyclopentenoxyethyl vinyl ether, methoxyethyl vinyl ether, ethoxyethyl vinyl ether, butoxyethyl vinyl ether, methoxyethoxyethyl vinyl ether, ethoxyethoxyethyl vinyl ether, methoxypolyethylene glycol vinyl ether, tetrahydrofurfuryl vinyl ether, 2-hydroxyethyl vinyl ether, 2-hydroxypropyl vinyl ether, 4-hydroxybutyl vinyl ether, 4-hydroxymethylcyclohexylmethyl vinyl ether, diethylene glycol monovinyl ether, polyethylene glycol vinyl ether, chloroethyl vinyl ether, chlorobutyl vinyl ether, chloroethoxyethyl vinyl ether, phenylethyl vinyl ether and phenoxypolyethylene glycol vinyl ether.

Examples of the polyfunctional vinyl ether include divinyl ethers such as ethylene glycol divinyl ether, diethylene glycol divinyl ether, polyethylene glycol divinyl ether, propylene glycol divinyl ether, butylene glycol divinyl ether, hexanediol divinyl ether, bisphenol A alkylene oxide divinyl ether and bisphenol F alkylene oxide divinyl ether; and polyfunctional vinyl others such as trimethylolethane trivinyl ether, trimethylolpropane trivinyl ether, ditrimethylolpropane tetravinyl ether, glycerin trivinyl ether, pentaerythritol tetravinyl ether, dipentaerythritol pentavinyl ether, dipentaerythritol hexavinyl ether, ethylene oxide-added trimethylolpropane trivinyl ether, propylene oxide-added trimethylolpropane trivinyl ether, ethylene oxide-added ditrimethylolpropane tetravinyl ether, propylene oxide-added ditrimethylolpropane tetravinyl ether, ethylene oxide-added pentaerythritol tetravinyl ether, propylene oxide-added pentaerythritol tetravinyl ether, ethylene oxide-added dipentaerythritol hexavinyl ether and propylene oxide-added dipentaerythritol hexavinyl ether.

As for the vinyl ether compound, a di- or trivinyl ether compound is preferred in view of curing property, adhesion to recording medium, surface hardness of image formed, or the like, and a divinyl ether compound is more preferred.

The oxetane compound as referred to in the present invention indicates a compound having an oxetane ring, and known oxetane compounds described, for example, in JP-A-2001-220526, JP-A-2001-310937 and JD-A-2003-341217 may be arbitrarily selected and used.

The compound having an oxetane ring, which can be used in the ink composition of the present invention, is preferably a compound having from one to four oxetane rings in the structure thereof. When such a compound is used, the viscosity of the ink composition can be easily maintained in the range allowing for good handling, and high adhesion can be obtained between the ink composition after curing and the recording medium.

Such a compound having an oxetane ring is described in detail in paragraphs [0021] to [0084] of JP-A-2003-341217, and compounds described therein can be suitably used also in the present invention.

Out of the oxetane compounds for use in the present invention, a compound having one oxetane ring is preferably used in view of viscosity and tackiness of the ink composition.

In the ink composition of the present invention, one of these cationic polymerizable compounds may be used alone, or two or more species thereof may be used in combination, but from the standpoint of effectively controlling the shrinkage on curing the ink, at least one compound selected from oxetane compounds and epoxy compounds is preferably used in combination with a vinyl ether compound.

The content of the (a) cationic polymerizable compound in the ink composition is suitably from 10 to 95 mass %, preferably from 30 to 90 mass %, more preferably from 50 to 85 mass %, based on the entire solid content of the composition.

[(b) Compound Capable of Generating an Acid Upon Irradiation with Active Energy Ray]

The ink composition of the present invention contains a compound capable of generating an acid upon irradiation with active energy ray (hereinafter appropriately referred to as a "photoacid generator").

The photoacid generator which can be used in the present invention may be appropriately selected from compounds capable of generating an acid upon irradiation with light (ultraviolet ray, far ultraviolet ray of 400 to 200 nm, visible ray of short-wavelength region (450 nm or less), g-ray, h-ray, i-ray or KrF excimer laser light), ArF excimer laser light, electron beam, X-ray, molecular beam or ion beam, which are used in a photo-cationic polymerization photoinitiator, a photo-radical polymerization photoinitiator, a photo-decolorizing agent for coloring matters, a photo-discoloring agent, a micro resist or the like.

Examples of such a photoacid generator include an onium salt which decomposes upon irradiation with UV light to generate an acid, such as diazonium salt, ammonium salt, phosphonium salt, iodonium salt, sulfonium salt, selenonium salt and arsonium salt; an organic halogen compound; an organic metal/organic halide, an o-nitrobenzyl type protective group-containing photoacid generator; a compound capable of undergoing photodecomposition to generate a sulfonic acid, as represented by imino sulfonate; a disulfone compound; a diazoketosulfone; and a diazodisulfone compound.

Furthermore, for example, oxazole derivatives and s-triazine derivatives described in paragraphs [0029] to [0030] of JP-A-2002-122994 may also be suitably used as the photoacid generator. In addition, onium salt compounds and sulfonate-based compounds described in paragraphs [0037] to [0063] of JP-A-2002-122994 may also be suitably used as the photoacid generator in the present invention.

As for the (b) photoacid generator, one species may be used alone or two or more species may be used in combination.

The content of the (b) photoacid generator in the ink composition is preferably from 0.1 to 20 mass %, more preferably from 0.5 to 10 mass %, still more preferably from 1 to 7 mass %, based on the entire solid content of the ink composition.

[(c) Colorant]

The ink composition of the present invention can form a visible image by adding thereto a colorant. For example, in the case of forming an image region of a lithographic printing plate, a colorant need not be necessarily added, but in view of suitability for plate inspection of the obtained lithographic printing plate, use of a colorant is also preferred.

The colorant which can be used here is not particularly limited, and various known coloring materials (pigment, dye) may be appropriately selected and used according to the usage. For example, in the case of forming an image with excellent weather resistance, a pigment is preferred. As far the dye, both a water-soluble dye and an oil-soluble dye may be used, but an oil-soluble dye is preferred

[Pigment]

The pigment which is preferably used in the present invention is described below.

The pigment is not particularly limited and, for example, all organic and inorganic pigments generally available on the market, those obtained by dispersing a pigment in a dispersion medium such au insoluble resin, and those obtained by grafting a resin to the pigment surface may be used. In addition, those obtained by, for example, dyeing a resin particle with a dye may also be used.

Examples of such a pigment include pigments described in Seishiro Ito (compiler), *Ganryo No Jiten* (*Pigment Dictionary*), published in 2000, W. Herbst and K. Hunger, *Industrial Organic Pigments*, JP-A-2002-12607, JP-A-2002-188025, JP-A-2003-26978 and JP-A-2003-342503.

Specific examples of the organic and inorganic pigments which can be used in the present invention are as follows. Example of the pigment which provides a yellow color include a monoazo pigment such as C.I. Pigment Yellow 1 (e.g., Fast Yellow G) and C.I. Pigment Yellow 74; a disazo pigment such as C.I. Pigment Yellow 12 (e.g., Disazo Yellow AAA) and C.I. Pigment Yellow 17; a non-benzidine-based azo pigment such as C.I. Pigment Yellow 180; an azo lake pigment such an C.I. Pigment Yellow 100 (e.g., Tartrazine Yellow Lake); a condensed azo pigment such as C.I. Pigment Yellow 95 (e.g., condensed Azo Yellow GR); an acidic dye lake pigment such as C.I. Pigment Yellow 115 (e.g., Quinoline Yellow Lake); a basic dye lake pigment such as C.I. Pigment Yellow 18 (e.g., Thioflavine Lake); an anthraquinone-based pigment such as Flavanthrone Yellow (Y-24); an isoindolinone pigment such as Isoindolinone Yellow 3RLT (Y-110); a quinophthalone pigment such as Quinophthalone Yellow (Y-138); an isoindoline pigment such as Isoindoline Yellow (Y-139); a nitroso pigment such as C.I. Pigment Yellow 153 (e.g., Nickel Nitroso Yellow); and a metal complex salt azomethine pigment such as C.I. Pigment Yellow 117 (e.g., Copper Azomethine Yellow).

Examples of the pigment which provides a red or magenta color include a monoazo-based pigment such as C.I. Pigment Red 3 (e.g., Toluidine Red); a disazo pigment such as C.I. Pigment Red 38 (e.g., Pyrazolone Red B); an azo lake pigment such as C.I. Pigment Red 53:1 (e.g., Lake Red C) and C.I. Pigment Red 57:1 (Brilliant Carmine 6B); a condensed azo pigment such as C.I. Pigment Red 144 (e.g., Condensed Azo Red BR); an acidic dye lake pigment such as C.I. Pigment Red 174 (e.g., Phloxine B Lake); a basic dye lake pigment such as C.I. Pigment Red 81 (e.g., Rhodamine 6G' Lake); an anthraquinone-based pigment such as C.I. Pigment Red 177 (e.g., Dianthraquinonyl Red); a thioindigo pigment such as C.I. Pigment Red 88 (e.g., Thioindigo Bordeaux); a perinone pigment such as C.I. Pigment Red 194 (e.g., Perinone Red); a perylene pigment such as C.I. Pigment Red 149 (e.g., Perylene Scarlet); a quinacridone pigment such as C.I. Pigment Violet 19 (unsubstituted quinacridone) and C.I. Pigment Red 122 (e.g., Quinacridone Magenta); an isoindolinone pigment such as C.I. Pigment Red 190 (e.g., Isoindolinone Red 2BLT); and an alizarin lake pigment such as C.I. Pigment Red 83 (e.g., Madder Lake).

Examples of the pigment which provides a blue or cyan color include a disazo-based pigment such as C.I. Pigment Blue 25 (e.g., Dianisidine Blue); a phthalocyanine pigment such as C.I. Pigment Blue 15 (e.g., Phthalocyanine Blue); an acidic dye lake pigment such as C.I. Pigment Blue 24 (e.g., Peacock Blue Lake); a basic dye lake pigment such as C.I. Pigment Blue 1 (e.g., Victoria Pure Blue BO Lake); an anthraquinone-based pigment such as C.I. Pigment Blue 60 (e.g., Indanthrone Blue); and an alkali blue pigment such as C.I. Pigment Blue 18 (Alkali Blue V-5:1).

Examples of the pigment which provides a green color include a phthalocyanine pigment such as C.I. Pigment Green 7 (Phthalocyanine Green) and C.I. Pigment Green 36 (Phthalocyanine Green); and an azo metal complex pigment such as C.I. Pigment Green 8 (Nitroso Green).

Examples of the pigment which provides an orange color include an isoindoline-based pigment such as C.I. Pigment Orange 66 (Isoindoline Orange); and an anthraquinone-based pigment such as C.I. Pigment Orange 51 (Dichloropyranthrone Orange).

Examples of the pigment which provides a black color include carbon black, titanium black and aniline black.

Specific examples of the white pigment which can be used include basic lead carbonate ($2PbCO_3Pb(OH)_2$, so-called "silver white"), zinc oxide (ZnO, so-called "zinc white"), titanium oxide ($TiO_2$, so-called "titanium white"), strontium titanate ($SrTiO_3$, so-called "titanium strontium white").

Here, titanium oxide has a low specific gravity and a high refractive index and is chemically and physically stable as compared with other white pigments and therefore, this pigment ensures that the masking power and coloring power as a pigment are high and the durability against acid, alkali and other environments is excellent. Because of this, titanium oxide is preferably used as the white pigment. As a matter of course, other white pigments (may also be a white pigment other than those described above) may be used, if desired.

The pigment may be dispersed by using a dispersing device such as ball mill, sand mill, attritor, roll mill, jet mill, homogenizer, paint shaker, kneader, agitator, Henschel mixer, colloid mill, ultrasonic homogenizer, pearl mill and wet jet mill.

When dispersing the pigment, a dispersant may also be added. Examples of the dispersant include a hydroxyl group-containing carboxylic acid ester, a salt of long chain polyaminoamide with high molecular weight acid ester, a salt of high molecular weight polycarboxylic acid, a high molecular weight unsaturated acid ester, a polymer copolymerization product, a modified polyacrylate, an aliphatic polyvalent carboxylic acid, a naphthalenesulfonic acid formalin condensate, a polyoxyethylene alkylphosphoric ester and a pigment derivative. A commercially available polymer dispersant such as Solsperse Series of Zeneca Ltd. may also be preferably used.

In addition, a synergist according to various pigments may be used as a dispersion aid. The dispersant or dispersion aid is preferably added in an amount of 1 to 50 parts by mass par 100 parts by mass of the pigment.

In the ink composition, a solvent may be added as a dispersion medium for various components such as pigment, or the (a) cationic polymerizable compound which is a low molecular weight component may be used as a dispersion medium without using a solvent. However, since the ink composition of the present invention is a UV-curable ink and the ink is applied onto a recording medium and then cured, the ink composition is preferably solvent-free. This is because when a solvent remains in the cured ink image, the solvent resistance may deteriorate or the residual solvent may cause a problem of VOC (volatile organic compound). From such a standpoint, the (a) cationic polymerizable compound is preferably used as the dispersion medium. Above all, in view of dispersion suitability or enhancement of handling property of the ink composition, a cationic polymerizable monomer having a lowest viscosity is preferably selected.

The average particle diameter of the pigment is preferably from 0.02 to 4 μm, more preferably from 0.02 to 2 μm, still more preferably from 0.02 to 1.0 μm.

The pigment, dispersant, dispersion medium and dispersion or filtration conditions are selected or set so that the pigment particle can have an average particle diameter in the above-described preferred range. By this control of the particle diameter, clogging of the head nozzle can be suppressed and the storage stability, transparency and curing sensitivity of ink can be maintained.

[Dye]

The dye for use in the present invention is preferably an oil-soluble dye. Specifically, the oil-soluble dye means a dye having a solubility in water at 25° C. (mass of the coloring matter dissolved in 100 g of water) of 1 g or less. The solubility is preferably 0.5 g or less, more preferably 0.1 g or less. Accordingly, a so-called water-insoluble oil-soluble dye is preferably used.

As regards the dye for use in the present invention, it is also preferred to introduce an oil-solubilizing group into the mother nucleus of the above-described dye for the purpose of dissolving a necessary amount of dye in the ink composition.

Examples of the oil-solubilizing group include a long-chain or branched alkyl group, a long-chain or branched alkoxy group, a long-chain or branched alkylthio group, a long-chain or branched alkylsulfonyl group, a long-chain or branched acyloxy group, a long-chain or branched alkoxycarbonyl group, a long-chain or branched acyl group, a long-chain or branched acylamino group, a long-chain or branched alkylsulfonylamino group, a long-chain or branched alkylaminosulfonyl group; and an aryl group, an aryloxy group, an aryloxycarbonyl group, an arylcarbonyloxy group, an arylaminocarbonyl group, an arylaminosulfonyl group and an arylsulfonylamino group, each containing the above-described long-chain or branched substituent.

Furthermore, the dye may be obtained from a water-soluble dye having a carboxyl acid or a sulfonic acid through conversion into an oil-solubilizing group, that is, an alkoxycarbonyl group, an aryloxycarbonyl group, an alkylaminosulfonyl group or an arylaminosulfonyl group, by using a long-chain or branched alcohol, an amine, a phenol or an aniline derivative.

The oil-soluble dye preferably has a melting point of 200° C. or less, more preferably 150° C. or less, still more preferably 100° C. By using an oil-soluble dye having a low melting point, crystal precipitation of the coloring matter in the ink composition is suppressed and the ink composition comes to have good storage stability.

Furthermore, for the purpose of improving resistance against fading, particularly against an oxidative substance such as ozone, or enhancing the curing property, the oxidation potential is preferably noble (high). For this reason, the oil-soluble dye for use in the present invention preferably has an oxidation potential of 1.0 V (vs SCE) or more. A higher oxidation potential is preferred, and the oxidation potential is more preferably 1.1 V (vs SCE) or more, still more preferably 1.15 V (vs SCE) or more.

As for the dye of yellow color, compounds having a structure represented by formula (Y-I) of JP-A-2004-250483 are preferred.

Dyes represented by formulae (Y-II) to (Y-IV) described in paragraph [0034] of JP-A-2004-250483 are more preferred. Specific examples thereof include compounds described in paragraphs [0060] to [0071] of JP-A-2004-250483. Incidentally, the oil-soluble dye of formula (Y-I) described in the patent publication above may be used not only for yellow ink but also for ink of any color, such as black ink and red ink.

As for the dye of magenta color, compounds having a structure represented by formula (3) or (4) described in JP-A-2002-114930 are preferred. Specific examples thereof include the compounds described in paragraphs [0054] to [0073] of JP-A-2002-114930.

Azo dyes represented by formulae (M-1) to (M-2) described in paragraphs [0084] to [0122] of JP-A-2002-121414 are more preferred, and specific examples thereof include the compounds described in paragraphs [0123] to [0132] of JP-A-2002-121414. Incidentally, the oil-soluble dyes of formulae (3), (4) and (M-1) to (M-2) described in these patent publications may be used not only for magenta ink but also for ink of any color, such as black ink and red ink.

As for the dye of cyan color, dyes represented by formulae (I) to (IV) of JP-A-2001-181547 and dyes represented by formulae (IV-1) to (IV-4) described in paragraphs [0063] to [0078] of JP-A-2002-121414 are preferred. Specific examples thereof include the compounds described in paragraphs [0052] to [0066] of JP-A-2001-181547 and the compounds described in paragraphs [0079] to [0081] of JP-A-2002-121414.

Phthalocyanine dyes represented by formulae (C-I) and (C-II) described in paragraphs [0133] to [0196] of JP-A 2002-121414 are more preferred, and the phthalocyanine dye represented by formula (C-II) is still more preferred. Specific examples thereof include the compounds described in paragraphs [0198] to [0201] of JP-A-2002-121414. Incidentally, the oil-soluble dyes of formulae (I) to (IV), (IV-1) to (TV-4), (C-I) and (C-II) may be used not only for cyan ink but also for ink of any color, such as black ink and green ink.

Such a colorant is preferably added in an amount of, in terms of the solid content, from 1 to 20 mass %, more preferably from 2 to 10 mass %, based on the ink composition.

In the ink composition of the present invention, in addition to the above-described essential components, various additives may be used in combination according to the purpose. These arbitrary components are described below.

[Ultraviolet Absorbent]

In the present invention, an ultraviolet absorbent may be used from the standpoint of giving an image enhanced in the weather resistance and prevented from fading.

Examples of the ultraviolet absorbent include benzotriazole-based compounds described in JP-A-58-185677, JP-A-61-190537, JP-A-2-782, JP-A-5-197075 and JP-A-9-34057; benzophenone-based compounds described in JP-A-46-2784, JP-A-5-194483 and U.S. Pat. No. 3,214,463; cinnamic acid-based compounds described in JP-B-48-30492 (the term "JP-B" as used herein means an "examined Japanese patent application"), JP-B-56-21141 and JP-A-10-88106; triazine-based compounds described in JP-A-4-298503, JP-A-8-53427, JP-A-8-239368, JP-A-10-182621 and JP-T-5011291 (the term (the term "JP-T" as used herein means a "published Japanese translation of a PCT patent application"); compounds described in *Research Disclosure*, No. 24239; and compounds capable of absorbing ultraviolet ray to emit fluorescence, so-called fluorescent brightening agent, as represented by a stilbene-based compound and a benzoxazole-based compound.

The amount of the ultraviolet absorbent added is appropriately selected according to the purpose but is generally on the order of 0.5 to 15 mass % in terms of the solid content.

[Sensitizer]

In the ink composition of the present invention, if desired, a sensitizer may be added for the purpose of enhancing the acid generation efficiency of the photoacid generator and shifting the photosensitive wavelength to a long wavelength side. The sensitizer may be any sensitizer as long as it can sensitize the photoacid generator by an electron or energy transfer mechanism. Preferred examples thereof include an aromatic polycondensed ring compound such as anthracene, 9,10-dialkoxyanthracene, pyrene and perylene; an aromatic ketone compound such as acetophenone, benzophenone, thioxanthone and Michler's ketone; and a heterocyclic compound such as phenothiazine and N-aryloxazolidinone. The amount of the sensitizer added is appropriately selected according to the purpose but is generally from 0.01 to 1 mol %, preferably from 0.1 to 0.5 mol %, based on the photoacid generator.

[Antioxidant]

An antioxidant may be added for the purpose of enhancing the stability of the ink composition. Examples of the antioxidant include those described in EP-A-223739, EP-A-309401, EP-A-309402, EP-A-310551, EP-A-310552, EP-A-459416, German Unexamined Patent Publication No. 3435443, EP-A-54-48535, JP-A-62-262047, JP-A-63-113536, JP-A-63-163351, JP-A-2-262654, JP-A-2-71262, JP-A-3-121449, JP-A-5-61166, JP-A-5-119449, and U.S. Pat. Nos. 4,814,262 and 4,920,275.

The amount of the antioxidant added is appropriately selected according to the purpose but is generally on the order of 0.1 to 8 mass % in terms of the solid content.

[Anti-Fading Agent]

In the ink composition of the present invention, various organic or metal complex-based anti-fading agents may be used. Examples of the organic anti-fading agent include hydroquinones, alkoxyphenols, dialkoxyphenols, phenols, anilines, amines, indanes, chromans, alkoxy-anilines and heterocyclic compounds. Examples of the metal complex-based anti-fading agent include a nickel complex and a zinc complex, and specifically, there may be used the compounds described in patents cited in *Research Disclosure*, No. 17643, No. VII, Items I to J, ibid., No. 15162, ibid., No. 18716, page 650, left column, ibid., No. 36544, page 527, ibid., No. 307105, page 872, and ibid., No. 15162; and the compounds included in formulae of representative compounds and in examples of the compounds describe on JP-A-62-215272, pp. 127-137.

The amount of the anti-fading agent added is appropriately selected according to the purpose but is generally on the order of 0.1 to 8 mass % in terms of the solid content.

[Electrically Conducting Salts]

In the ink composition of the present invention, electrically conducting salts such as potassium thiocyanate, lithium nitrate, ammonium thiocyanate and dimethylamine hydrochloride may be added for the purpose of controlling the ejection physical property

[Solvent]

In the ink composition of the present invention, addition of an organic solvent in an extremely small amount is also effective for the purpose of improving the adhesion to a recording medium.

Examples of the solvent include a ketone-based solvent such as acetone, methyl ethyl ketone and diethyl ketone; an alcohol-based solvent such as methanol, ethanol, 2-propanol, 1-propanol, 1-butanol and tert-butanol; a chlorine-based solvent such as chloroform and methylene chloride; an aromatic solvent such as benzene and toluene; an ester-based solvent such as ethyl acetate, butyl acetate and isopropyl acetate, an ether-based solvent such as diethyl ether, tetrahydrofuran and dioxane; and a glycol ether-based solvent such as ethylene glycol monomethyl ether and ethylene glycol dimethyl ether.

In this case, addition in the range of not causing a problem in the solvent resistance or VOC is effective, and this amount is preferably from 0.1 to 5 mass %, more preferably from 0.1 to 3 mass %, based on the entire ink composition.

[Polymer Compound]

In the ink composition of the present invention, various polymer compounds may be added for the purpose of adjusting the film physical properties. Examples of the polymer compound which can be used include an acryl-based polymer, a polyvinyl butyral resin, a polyurethane resin, a polyamide resin, a polyester resin, an epoxy resin, a phenol resin, a polycarbonate resin, a polyvinyl butyral resin, a polyvinyl formal resin, a shellac, a vinyl-based resin, an acryl-based resin, a rubber-based resin, waxes and other natural resins. Also, two or more species thereof may be used in combination. Among these, a vinyl-based copolymer obtainable by the copolymerization of an acryl-based monomer is preferred. In addition, as for the copolymerization composition of the polymer binder, a copolymer containing, as the structural unit, a "carboxyl group-containing monomer", an "alkyl methacrylate" or an "alkyl acrylate" is also preferably used.

[Surfactant]

In the ink composition of the present invention, a surfactant may also be added.

The surfactant includes those described in JP-A-62-173463 and JP-A-62-183457. Examples thereof include an anionic surfactant such as dialkylsulfosuccinates, alkylnaphthalenesulfonates and fatty acid salts; a nonionic surfactant such as polyoxyethylene alkyl ethers, polyoxyethylene alkylallyl ethers, acetylene glycols and polyoxyethylene-polyoxypropylene block copolymers; and a cationic surfactant such as alkylamine salts and quaternary ammonium salts. Incidentally, an organic fluoro compound may be used in place of the surfactant above. The organic fluoro compound is preferably hydrophobic. Examples of the organic fluoro compound include a fluorine-containing surfactant, an oily fluorine-containing compound (e.g., fluorine oil), a solid fluorine compound resin (e.g., tetrafluoroethylene resin), and those described in JP-B-57-9053 (columns 8 to 17) and JP-A-62-135026.

Other than these, for example, a leveling additive, a matting agent, waxes for adjusting the film physical properties, and a tackifier for improving adhesion to a recording medium such as polyolefin and PET, which does not inhibit the polymerization, may be added, if desired.

Specific examples of the tackifier include high molecular weight adhesive polymers described in JP-A-2001-49200, pp. 5-6 (for example, a copolymer comprising an ester of a (meth)acrylic acid and an alcohol containing an alkyl group having a carbon number of 1 to 20, an ester of a (meth)acrylic acid and an alicyclic alcohol having a carbon number of 3 to 14, or an ester of a (meth)acrylic acid and an aromatic alcohol having a carbon number of 6 to 14); and a low molecular weight tackifier resin having a polymerizable unsaturated bond.

[Radical Polymerization-Type Ink Composition]

The radical polymerization-type ink composition contains (d) a radical polymerizable compound, (e) a polymerization initiator and (f) a colorant and, if desired, may further contain a sensitizing dye, a co-sensitizer and the like.

The constituent components used in the radical polymerization-type ink composition are described below in sequence.

(d) [Radical Polymerizable Compound]

The radical polymerizable compound includes, for example, the following compound having an addition-polymerizable ethylenically unsaturated bond.

[Compound Having Addition-Polymerizable Ethylenically Unsaturated Bond]

Examples of the compound having an addition-polymerizable ethylenically unsaturated bond, which can be used in the ink composition of the present invention, include an ester of an unsaturated carboxylic acid (e.g., acrylic acid, methacrylic acid, itaconic acid, crotonic acid, isocrotonic acid, maleic acid) and an aliphatic polyhydric alcohol compound, and an amide of the above-described unsaturated carboxylic acid and an aliphatic polyvalent amine compound.

Specific examples of the ester monomer of an aliphatic polyhydric alcohol compound and an unsaturated carboxylic acid include the followings. Examples of the acrylic ester include ethylene glycol diacrylate, triethylene glycol diacrylate, 1,3-butanediol diacrylate, tetramethylene glycol diacrylate, propylene glycol diacrylate, neopentyl glycol diacrylate, trimethylolpropane triacrylate, trimethylolpropane tri(acryloyloxypropyl)ether, trimethylolethane triacrylate, hexanediol diacrylate, 1,4-cyclohexanediol diacrylate, tetraethylene glycol diacrylate, pentaerythritol diacrylate, pentaerythritol triacrylate, pentaerythritol tetraacrylate, dipentaerythritol diacrylate, dipentaerythritol hexaacrylate, sorbitol triacrylate, sorbitol tetraacrylate, sorbitol pentaacrylate, sorbitol hexaacrylate, tri(acryloyloxyethyl) isocyanurate, and polyester acrylate oligomer.

Examples of the methacrylic acid ester include tetramethylene glycol dimethacrylate, triethylene glycol dimethacrylate, neopentyl glycol dimethacrylate, trimethylolpropane trimethacrylate, trimethylolethane trimethacrylate, ethylene glycol dimethacrylate, 1,3-butanediol dimethacrylate, hexanediol dimethacrylate, pentaerythritol dimethacrylate, pentaerythritol trimethacrylate, pentaerythritol tetramethacrylate, dipentaerythritol dimethacrylate, dipentaerythritol hexamethacrylate, sorbitol trimethacrylate, sorbitol tetramethacrylate, bis[p-(3-methacryloxy-2-hydroxypropoxy) phenyl]dimethylmethane, and bis[p-(acryloxyethoxy)phenyl]-dimethylmethane. Examples of itaconic acid ester include ethylene glycol diitaconate, propylene glycol diitaconate, 1,3-butanediol diitaconate, 1,4-butanediol diitaconate, tetramethylene glycol diitaconate, pentaerythritol diitaconate, and sorbitol tetraitaconate.

Examples of the crotonic acid ester include ethylene glycol dicrotonate, tetramethylene glycol dicrotonate, pentaerythritol dicrotonate, and sorbitol tetradicrotonate. Examples of the isocrotonic acid ester include ethylene glycol diisocrotonate, pentaerythritol diisocrotonate and sorbitol tetraisocrotonate. Examples of the maleic acid ester include ethylene glycol dimaleate, triethylene glycol dimaleate, pentaerythritol dimaleate and sorbitol tetramaleate. In addition, a mixture of these ester monomers may also be used. Specific examples of the amide monomer of an aliphatic polyvalent amine compound and an unsaturated carboxylic acid include methylenebis-acrylamide, methylenebis-methacrylamide, 1,6-hexamethylenebis-acrylamide, 1,6-hexamethylenebis-methacrylamide, diethylene triamine trisacrylamide, xylylenebisacrylamide, and xylylenebismethacrylamide.

Other examples include a vinyl urethane compound containing two or more polymerizable vinyl groups within one molecule, which is obtained by adding a hydroxyl group-containing vinyl monomer represented by the following formula (A) to a polyisocyanate compound containing two or more isocyanate groups within one molecule, described in JP-B-48-41708. $CH_2{=}C(R)COOCH_2CH(R')OH$ (A) (wherein R and R' each represents H or $CH_3$).

Still other examples include a functional acrylate or methacrylate such as urethane acrylates described in JP-A-51-37193, polyester acrylates described in JP-A-48-64183, JP-B-49-43191 and JP-B-52-30490, and epoxy acrylates obtained by reacting an epoxy resin and a (meth)acrylic acid. Furthermore, those described as a photocurable monomer or oligomer in *Journal of the Adhesion Society of Japan*, Vol. 20, No. 7, pp. 300-308 (1984) may also be used. In the present invention, these monomers can be used in a chemical form such as a prepolymer, namely, dimer, trimer or oligomer, or a mixture or copolymer thereof.

The amount of the radical polymerizable compound used is usually from 1 to 99.99%, preferably from 5 to 90.0%, more preferably from 10 to 70% ("%" as used herein indicates "mass %"), based on all components of the ink composition.

(e) [Photopolymerization Initiator]

The photopolymerization initiator for use in the radical polymerization-type ink composition of the present invention is described below.

The photopolymerization initiator as used in the present invention indicates a compound capable of undergoing a chemical change under the action of light or through interaction with the electron excited state of a sensitizing dye and thereby producing at least one species of a radical, an acid and a base.

Preferred examples of the photopolymerization initiator include (i) aromatic ketones, (ii) an aromatic onium salt compound, (iii) an organic peroxide, (iv) a hexaarylbiimidazole compound, (v) a ketoxime ester compound, (vi) a borate compound, (vii) an azinium compound, (viii) a metallocene compound, (vix) an active ester compound, and (x) a carbon-halogen bond-containing compound.

(f) [Colorant]

A colorant the same as those described for the (c) colorant regarding the cationic polymerization-type ink composition may be utilized.

In the ink composition of the present invention, in addition to the above-described essential components, various additives may be used in combination according to the purpose. These arbitrary components are described below.

[Sensitizing Dye]

In the present invention, a sensitizing dye may be added for the purpose of improving the sensitivity of the photopolymerization initiator. Preferred examples of the sensitizing dye include those belonging to the following compounds and having an absorption wavelength in the region from 350 to 450 nm.

That is, the compounds are polynuclear aromatics (e.g., pyrene, perylene, triphenylene), xanthenes (e.g., fluorescein, eosin, erythrosin, Rhodamine B, Rose Bengale), cyanines (e.g., thiacarbocyanine, oxacarbocyanine), merocyanines (e.g., merocyanine, carbomerocyanine), thiazines (e.g., thionine, Methylene Blue, Toluidine Blue), acridines (e.g., Acridine Orange, chloroflavin, acriflavine), anthraquinones (e.g. anthraquinone), squaryliums (e.g., squarylium), and coumarins (e.g., 7-diethylamino-4-methyl coumarin).

[Co-Sensitizer]

Furthermore, in the ink of the present invention, a known compound having an activity of, for example, more enhancing the sensitivity or suppressing the polymerization inhibition by oxygen may be added as a co-sensitizer.

Examples of such a co-sensitizer include amines such as compounds described in M. R. Sander, et al., *Journal of Polymer Society*, Vol. 10, page 3173 (1972), JP-B-44-20189, JP-A-51-82102, JP-A-52-134692, JP-A-59-138205, JP-A-60-84305, JP-A-62-18537, JP-A-64-33104, and *Research Disclosure*, No. 33825. Specific examples thereof include triethanolamine, ethyl p-dimethylaminobenzoate, p-formyldimethylaniline and p-methylthiodimethylaniline.

Other examples include thiols and sulfides such as thiol compounds described in JP-A-53-702, JP-B-55-500806, and JP-A-5-142772 and disulfide compounds described in JP-A-56-75643. Specific examples thereof include 2-mercaptobenzothiazole, 2-mercaptobenzoxazole, 2-mercaptobenzimidazole, 2-mercapto-4(3H)-quinazoline and β-mercaptonaphthalene.

Still other examples include an amino acid compound (e.g., N-phenylglycine), organometallic compounds described in JP-B-48-42965 (e.g., tributyltin acetate), hydrogen donors described in JP-B-55-34414, sulfur compounds described in JP-A-6-308727 (e.g., trithian), phosphorus compounds described in JP-A-6-250387 (e.g., diethyl phosphite), and Si—H and Ge—H compounds described in Japanese Patent Application No. 6-191605.

Also, in view of enhancing the storability, a polymerization inhibitor is preferably added in an amount of 200 to 20,000 ppm. The ink for ink-jet recording of the present invention is preferably ejected after heating it in the range from 40 to 80° C. and thereby decreasing the viscosity, and also for preventing head clogging due to thermal polymerization, addition of a polymerization inhibitor is preferred. Examples of the polymerization inhibitor include hydroquinone, benzoquinone, p-methoxyphenol, TEMPO, TEMPOL and cupferron Al.

[Others]

In addition, known compounds may be used as needed. For example, a surfactant, a leveling additive, a matting agent and, for adjusting the film physical properties, a polyester-based resin, a polyurethane-based resin, a vinyl-based resin, an acryl-based resin, a rubber-based resin or waxes, may be appropriately selected and used. Furthermore, in order to improve the adhesion to a recording medium such an polyolefin and PET, a tackifier which does not inhibit the polymerization is also preferably contained. Specific examples thereof include high molecular weight adhesive polymers described in JP-A-2001-49200, pp. 5-6 (for example, a copolymer comprising an ester of a (meth)acrylic acid and an alcohol containing an alkyl group having a carbon number of 1 to 20, an ester of a (meth)acrylic acid and an alicyclic alcohol having a carbon number of 3 to 14, or an ester of a (meth)acrylic acid and an aromatic alcohol having a carbon number of 6 to 14); and a low molecular weight tackifier resin having a polymerizable unsaturated bond.

Also, addition of an organic solvent in an extremely small amount is effective for the purpose of improving adhesion to a recording medium. In this case, addition in the range of not causing a problem in the solvent resistance or VOC is effective, and this amount is preferably from 0.1 to 5 mass %, more preferably from 0.1 to 3 mass %, based on the entire ink composition.

Furthermore, as the means for preventing reduction in the sensitivity due to light-shielding effect of the coloring material in the ink, it is also one preferred embodiment to form a radical/cation hybrid-type curing ink by combining a cationic polymerizable monomer having a long life as the polymerization initiator with a polymerization initiator.

[Aqueous Ink Composition]

The aqueous ink composition contains a polymerizable compound and a water-soluble photopolymerization initiator capable of generating a radical under the action of UV light and if desired, may further contain a coloring material and the like.

[Polymerizable Compound]

As for the polymerizable compound contained in the aqueous ink composition of the present invention, a polymerizable compound contained in known aqueous ink compositions may be used.

In the aqueous ink composition, a reactive material may be added so as to optimize the formulation by taking into account end user characteristics such as curing rate, adhesion and flexibility. For example, a (meth)acrylate (namely, acrylate and/or methacrylate) monomer or oligomer, an epoxide and an oxetane are used as such a reactive material.

Examples of the acrylate monomer include a phenoxyethyl acrylate, an octyldecyl acrylate, a tetrahydrofuryl acrylate, an isobornyl acrylate, a hexanediol diacrylate, a trimethylolpropane triacrylate, a pentaerythritol triacrylate, a polyethylene glycol diacrylate (e.g., tetraethylene glycol diacrylate), a dipropylene glycol diacrylate, a tri(propylene glycol) triacrylate, a neopentyl glycol diacrylate, a bis(pentaerythritol) hexaacrylate, an acrylate of ethoxylated or propoxylated glycol and polyol (e.g., propoxylated neopentyl glycol diacrylate, ethoxylated trimethylolpropane triacrylate), and a mixture thereof.

Examples of the acrylate oligomer include an ethoxylated polyethylene glycol, an ethoxylated trimethylolpropane acrylate, a polyether acrylate including its ethoxylated product, and a urethane acrylate oligomer.

Examples of the methacrylate include a hexanediol dimethacrylate, a trimethylolpropane trimethacrylate, a triethylene glycol dimethacrylate, a diethylene glycol dimethacrylate, an ethylene glycol dimethacrylate, a 1,4-butanediol dimethacrylate, and a mixture thereof.

The amount of the oligomer added is preferably from 1 to 80 wt %, more preferably from 1 to 10 wt %, based on the entire weight Of the ink composition.

[Water-Soluable Photopolymerization Initiator Capable of Producing a Radical Under the Action of UV Light]

The polymerization initiator which can be used in the ink composition of the present invention is described below. As one example, a photopolymerization initiator up to a wavelength of around 400 nm may be used. Examples of such a photopolymerization initiator include photopolymerization initiators represented by the following formulae, which are a substance having functionality in a long wavelength region, namely, sensitivity of producing a radical when irradiated with ultraviolet rays (hereinafter simply referred to as a "TX system"). In the present inventions particularly, a photopolymerization initiator appropriately selected from these is preferably used.

TX-1

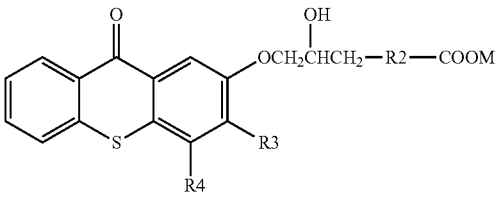

TX-2

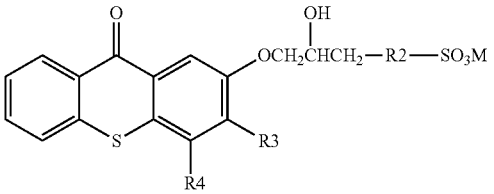

TX-3

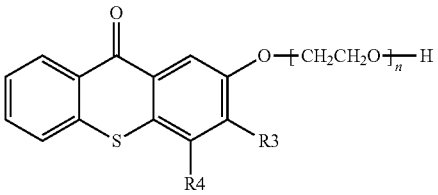

In formulae TX-1 to TX-3, R2 represents —$(CH_2)_x$— (wherein x is 0 or 1), —O—$(CH_2)_y$— (wherein y is 1 or 2), or a substituted or unsubstituted phenylene group. When R2 is a phenylene group, at least one of the hydrogen atoms in the benzene ring may be substituted by one group or atom or two or more groups or atoms selected from, for example, a carboxyl group or a salt thereof, a sulfonic acid or a salt thereof, a linear or branched alkyl group having a carbon number of 1 to 4, a halogen atom (e.g., fluorine, chlorine, bromine), an alkoxyl group having a carbon number of 1 to 4, and an aryloxy group such as phenoxy group M represents a hydrogen atom or an alkali metal (e.g., Li, Na, K). R3 and R4 each independently represents a hydrogen atom or a substituted or unsubstituted alkyl group. Examples of the alkyl group include a linear or branched alkyl group having a carbon number of approximately from 1 to 10, particularly, a carbon number of approximately from 1 to 3. Examples of the substituent for this alkyl group include a halogen atom (e.g., fluorine, chlorine, bromine), a hydroxyl group, and an alkoxyl group (having a carbon number of approximately from 1 to 3). m represents an integer of 1 to 10.

In the present invention, a water-soluable derivative of a photopolymerization initiator, Irgacure 2959 (trade name, produced by Ciba Specialty Chemicals), represented by the following formula (hereinafter simply referred to as an "IC system") may be used. Specifically, IC-1 to IC-3 of the following formulae may be used.

Formula:

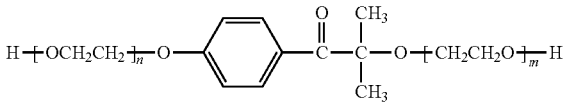

(n = 2~5, m = 0~5)

-continued

IC-1

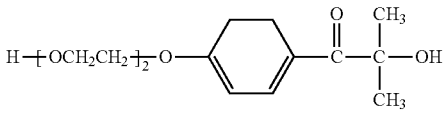

IC-2

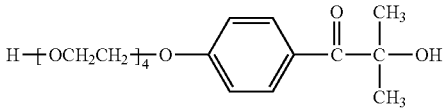

IC-3

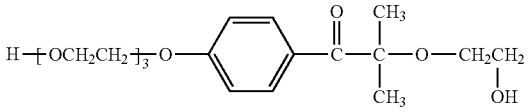

[Formulation for Clear Ink]

By using the water-soluble polymerizable compound in the form of a transparent aqueous ink without incorporating the above-described coloring material, a clear ink can be prepared. In particular, when the ink is prepared to have ink-jet recording property, an aqueous photocuring-type clear ink for ink-jet recording is obtained. This ink contains no coloring material and therefore, a clear film can be obtained by using the ink. Examples of the usage of the coloring material-free clear ink include use as an undercoat for imparting suitability for image printing to a recording material, and use as an overcoat for protecting the surface of an image formed by a normal ink or further imparting decoration, gloss or the like. In the clear ink, a colorless pigment, a fine particle or the like not for the purpose of coloration may be incorporated by dispersion according to the usage above. By this addition, various properties such as image quality, fastness and processability (handling property) of a printed matter can be enhanced in both cases of undercoat and overcoat.

As for the formulation conditions in such application to a clear ink, the ink is preferably prepared to contain a water-soluble polymerizable compound as the main component of the ink in a proportion of 10 to 85% and a photo polymerization initiator (for example, an ultraviolet polymerization catalyst) in an amount of 1 to 10 parts by mass per 100 parts by mass of the water-soluble polymerizable compound and at the same time, contain a photopolymerization initiator in an amount of at least 0.5 parts per 100 parts of the ink.

[Material Construction in Coloring Material-Containing Ink]

In the case of using the water-soluble polymerizable compound for a coloring material-containing ink, the concentrations of the polymerization initiator and polymerizable substance in the ink are preferably adjusted according to the absorption characteristics of the coloring material contained. As described above, the blending amount is set such that the amount of water or solvent is, on the mass basis, from 40 to 90%, preferably from 60 to 75%. Also, the content of the polymerizable compound in the ink is set to, on the mass basis, from 1 to 30%, preferably from 5 to 20%, based on the entire amount of the ink. The amount of the polymerization initiator depends on the content of the polymerizable compound but is generally, on the mass basis, from 0.1 to 7%, preferably from 0.3 to 5%, based on the entire amount of the ink.

In the case where a pigment is used as the coloring material of the ink, the concentration of the pure pigment portion in the ink is generally from 0.3 to 10 mass % based on the entire amount of the ink. The coloring power of the pigment depends on the dispersed state of pigment particles, but when the concentration is approximately from 0.3 to 1%, this is in the range of use as a light color ink, whereas the value exceeding the range above gives a concentration employed for normal coloration.

[Preferred Physical Properties of Ink Composition]

Taking into account the ejection property, the ink composition of the present invention preferably has an ink viscosity of 20 mPa·s or less, more preferably 10 mPa·s or less, at the ejection temperature, and an appropriate compositional ratio is preferably determined to give an ink viscosity in this range.

The surface tension in common of the ink composition of the present invention is preferably from 20 to 40 mN/m, more preferably from 25 to 35 mN/m. In the case of recording an image on various recording mediums such as polyolefins, PET, coated paper and non-coated paper, the surface tension is preferably 20 mN/m or more in view of bleeding and penetration and is preferably 40 mN/m or less in view of wettability.

The thus-prepared ink composition of the present invention is suitably used as an ink for ink-jet recording. In the case of using the ink composition as an ink for ink-jet recording, the ink composition is ejected on a recording medium by an ink-jet printer and the ink composition ejected is then cured by irradiating thereon UV light, whereby recording is performed.

The printed matter obtained using this ink has an image area cured by the irradiation of UV light such as ultraviolet ray and is assured of excellent strength of the image area and therefore, the ink composition can be used fox various uses such as formation of an ink-receiving layer (image area) of a lithographic printing plate, other than the formation of an image.

This application is based on Japanese Patent application JP 2007-085391, filed Mar. 28, 2007, the entire content of which is hereby incorporated by reference, the same as if fully set forth herein.

Although the invention has been described above in relation to preferred embodiments and modifications thereof, it will be understood by those skilled in the art that other variations and modifications can be effected in these preferred embodiments without departing from the scope and spirit of the invention.

What is claimed is:

1. A UV curable ink-jet recording apparatus comprising: a recording medium transporting unit for transporting a recording medium; an ink jet head which, on the basis of an image signal, ejects an ink that is curable by UV irradiation, toward the recording medium transported by said recording medium transporting unit; and a UV irradiating unit for curing the ink which is ejected onto the recording medium by said ink jet head, wherein said apparatus comprises a light capturing portion between said UV irradiating unit and said ink-jet head, at least a part of said light capturing portion as seen in a longitudinal section taken vertically along a direction of transporting the recording medium has an opened wedge shape having no base side and comprising:

a side vertical to the recording medium; and an oblique side which is in contact with a top of the vertical side, and which extends obliquely downward, the vertical side is located on the side of said ink-jet head, and the oblique side downward extends from the top toward said UV irradiating unit; and a light shielding side which is in contact with a lower end of the oblique side, wherein when a distance between both lower ends of an opening of said wedge-shaped light capturing portion in the direction of transporting the recording medium is a, a gap between the recording medium and the lower ends of said light capturing portion is b, and $\tan\theta=2b/a$, an opening angle of the wedge shape is $\alpha\leqq\theta/2$, and an angle $\beta$ formed by the oblique side of the wedge shape and a light shielding side which shields said UV irradiating unit is $90°<\beta\leqq180°$.

2. The UV curable ink-jet recording apparatus according to claim 1, wherein an inside of said light capturing portion is configured by a material which has a UV reflectivity of 50% or less.

* * * * *